US011692255B2

(12) United States Patent
Felberbaum et al.

(10) Patent No.: US 11,692,255 B2
(45) Date of Patent: Jul. 4, 2023

(54) HIGH STRENGTH 7XXX SERIES ALUMINUM ALLOYS AND METHODS OF MAKING THE SAME

(71) Applicant: NOVELIS INC., Atlanta, GA (US)

(72) Inventors: Milan Felberbaum, Woodstock, GA (US); Sazol Kumar Das, Acworth, GA (US); Duane E. Bendzinski, Woodstock, GA (US); Rajeev G. Kamat, Marietta, GA (US); Tudor Piroteala, Acworth, GA (US); Rajasekhar Talla, Woodstock, GA (US)

(73) Assignee: Novelis Inc., Atlanta, GA (US)

( * ) Notice: Subject to any disclaimer, the term of this patent is extended or adjusted under 35 U.S.C. 154(b) by 318 days.

(21) Appl. No.: 15/716,654

(22) Filed: Sep. 27, 2017

(65) Prior Publication Data

US 2018/0119262 A1 May 3, 2018

Related U.S. Application Data

(60) Provisional application No. 62/529,028, filed on Jul. 6, 2017, provisional application No. 62/505,944, filed (Continued)

(51) Int. Cl.
*C22C 21/10* (2006.01)
*C22F 1/053* (2006.01)

(Continued)

(52) U.S. Cl.
CPC ..... *C22F 1/053* (2013.01); *B22D 11/003* (2013.01); *B22D 11/1206* (2013.01); *C22C 1/02* (2013.01);

(Continued)

(58) Field of Classification Search
CPC ..... C22F 1/04–057
See application file for complete search history.

(56) References Cited

U.S. PATENT DOCUMENTS 3,612,151 A 10/1971 Harrington et al.
3,933,193 A 1/1976 Baker et al.

(Continued)

FOREIGN PATENT DOCUMENTS

CA 2900625 8/2014
CN 1200771 12/1998

(Continued)

OTHER PUBLICATIONS

Lohne et al., "Quench sensitivity in AlMgSi alloys containing manganese or chromium", Scandinavian J of Met 12 (1983) 34-36.

(Continued)

*Primary Examiner* — Lois L Zheng
(74) *Attorney, Agent, or Firm* — Kilpatrick Townsend & Stockton LLP

(57) ABSTRACT

Described herein are 7xxx series aluminum alloys with unexpected properties and novel methods of producing such aluminum alloys. The aluminum alloys exhibit high strength and are highly formable. The alloys are produced by continuous casting and can be hot rolled to a final gauge and/or a final temper. The alloys can be used in automotive, transportation, industrial, and electronics applications, just to name a few.

14 Claims, 12 Drawing Sheets

Related U.S. Application Data on May 14, 2017, provisional application No. 62/413,591, filed on Oct. 27, 2016, provisional application No. 62/413,764, filed on Oct. 27, 2016.

(51) Int. Cl.

| | |
|---|---|
| ***C22C 1/02*** | (2006.01) |
| ***C22F 1/047*** | (2006.01) |
| ***B22D 11/12*** | (2006.01) |
| ***B22D 11/00*** | (2006.01) |
| *C22C 21/18* | (2006.01) |
| *C22C 21/08* | (2006.01) |

(52) U.S. Cl.

CPC ..... *C22C 21/10* (2013.01); *C22F 1/047* (2013.01); *C22C 21/08* (2013.01); *C22C 21/18* (2013.01)

(56) References Cited

U.S. PATENT DOCUMENTS

| | | | | |
|---|---|---|---|---|
| 4,028,141 | A | 6/1977 | Chia et al. | |
| 4,174,232 | A | 11/1979 | Lenz et al. | |
| 4,194,553 | A | 3/1980 | Kimura et al. | |
| 4,238,248 | A | 12/1980 | Gyongyos et al. | |
| 4,614,552 | A | 9/1986 | Fortin et al. | |
| 4,698,897 | A | 10/1987 | Frommann et al. | |
| 4,753,685 | A | 6/1988 | Usui et al. | |
| 4,808,247 | A | 2/1989 | Komatsubara et al. | |
| 4,823,860 | A | 4/1989 | Lauener | |
| 4,869,310 | A | 9/1989 | Yanagi et al. | |
| 4,976,024 | A | 12/1990 | Kimura | |
| 5,046,347 | A | 9/1991 | Crosato et al. | |
| 5,244,516 | A | 9/1993 | Kawaguchi | |
| 5,461,770 | A | 10/1995 | Kimura et al. | |
| 5,548,882 | A | 8/1996 | Windhaus et al. | |
| 5,560,789 | A | 10/1996 | Sainfort et al. | |
| 5,720,335 | A | 2/1998 | Osada et al. | |
| 5,779,824 | A | 7/1998 | Sawada et al. | |
| 6,289,972 | B1 | 9/2001 | Benedetti | |
| 6,471,796 | B1 | 10/2002 | Kagohara et al. | |
| 6,579,387 | B1 | 6/2003 | Selepack et al. | |
| 6,755,236 | B1 | 6/2004 | Sivilotti et al. | |
| 6,789,602 | B2 | 9/2004 | Li et al. | |
| 7,182,825 | B2 | 2/2007 | Unai et al. | |
| 7,380,583 | B2 | 6/2008 | Gallerneault et al. | |
| 7,448,432 | B2 | 11/2008 | Barker et al. | |
| 10,493,508 | B2 | 12/2019 | Bassi et al. | |
| 10,533,243 | B2 | 1/2020 | Newman et al. | |
| 10,550,455 | B2 | 2/2020 | Hosch et al. | |
| 2003/0150587 | A1 | 8/2003 | Li et al. | |
| 2003/0173003 | A1 | 9/2003 | Selepack et al. | |
| 2004/0011438 | A1 | 1/2004 | Lorentzen et al. | |
| 2004/0089382 | A1* | 5/2004 | Senkov | C22C 21/10 148/701 |
| 2004/0094245 | A1 | 5/2004 | Li et al. | |
| 2004/0129353 | A1 | 7/2004 | Verma et al. | |
| 2005/0028894 | A1 | 2/2005 | Hoffmann et al. | |
| 2005/0086784 | A1 | 4/2005 | Li et al. | |
| 2005/0211350 | A1 | 9/2005 | Unal et al. | |
| 2005/0288894 | A1 | 12/2005 | Vorenkamp et al. | |
| 2007/0209739 | A1 | 9/2007 | Zhao | |
| 2008/0035301 | A1 | 2/2008 | Arvedi | |
| 2009/0178778 | A1 | 7/2009 | Seidel et al. | |
| 2010/0212856 | A1 | 8/2010 | Rosenthal et al. | |
| 2011/0111081 | A1* | 5/2011 | Chen | C22F 1/053 425/542 |
| 2012/0024434 | A1 | 2/2012 | Franz et al. | |
| 2013/0334091 | A1 | 12/2013 | Sawtell et al. | |
| 2014/0250963 | A1 | 9/2014 | Nelson et al. | |
| 2015/0071816 | A1 | 3/2015 | Unal et al. | |
| 2015/0218679 | A1* | 8/2015 | Aruga | C22C 21/10 420/532 |
| 2015/0252461 | A1 | 9/2015 | Kokubo et al. | |
| 2015/0328670 | A1 | 11/2015 | Alken et al. | |
| 2017/0175240 | A1 | 6/2017 | Wen et al. | |
| 2017/0198376 | A1 | 7/2017 | Newman et al. | |
| 2018/0087138 | A1 | 3/2018 | Gaensbauer et al. | |
| 2018/0112296 | A1 | 4/2018 | Bryant et al. | |
| 2018/0112298 | A1 | 4/2018 | Weykamp | |
| 2018/0117650 | A1 | 5/2018 | Felberbaum et al. | |
| 2018/0117669 | A1 | 5/2018 | Felberbaum et al. | |
| 2018/0119261 | A1 | 5/2018 | Das et al. | |
| 2018/0297092 | A1 | 10/2018 | Chung et al. | |
| 2019/0022720 | A1 | 1/2019 | Shafiei et al. | |
| 2019/0022721 | A1 | 1/2019 | Shafiei et al. | |
| 2019/0022724 | A1 | 1/2019 | Shafiei et al. | |
| 2019/0054519 | A1 | 2/2019 | Barker | |

FOREIGN PATENT DOCUMENTS

| | | | | |
|---|---|---|---|---|
| CN | 1207965 | | 2/1999 | |
| CN | 1505692 | | 6/2004 | |
| CN | 1662670 | | 8/2005 | |
| CN | 1942595 | | 4/2007 | |
| CN | 101896631 | | 11/2010 | |
| CN | 102413955 | | 4/2012 | |
| CN | 103119185 | | 5/2013 | |
| CN | 103131904 | | 6/2013 | |
| CN | 103510029 | | 1/2014 | |
| CN | 103764305 | | 4/2014 | |
| CN | 104093868 | | 10/2014 | |
| CN | 104109784 | | 10/2014 | |
| CN | 104284745 | | 1/2015 | |
| CN | 104321451 | | 1/2015 | |
| CN | 104364409 | | 2/2015 | |
| CN | 104411846 | | 3/2015 | |
| CN | 104583433 | | 4/2015 | |
| CN | 104762575 | | 7/2015 | |
| CN | 105397045 | A | 3/2016 | |
| CN | 105734369 | | 7/2016 | |
| CN | 105814222 | | 7/2016 | |
| EP | 2813592 | | 12/2014 | |
| GB | 1387992 | | 3/1975 | |
| GB | 2027743 | | 2/1980 | |
| JP | 60152348 | | 8/1985 | |
| JP | 60201839 | | 10/1985 | |
| JP | 621839 | | 1/1987 | |
| JP | 6283453 | | 4/1987 | |
| JP | 6289502 | A | 4/1987 | |
| JP | 06322493 | | 11/1994 | |
| JP | 0790459 | | 4/1995 | |
| JP | 07252573 | | 10/1995 | |
| JP | 09327706 | A | 12/1997 | |
| JP | 10502973 | | 3/1998 | |
| JP | 10130768 | | 5/1998 | |
| JP | 2000017412 | | 1/2000 | |
| JP | 2000210760 | | 8/2000 | |
| JP | 2000212673 | | 8/2000 | |
| JP | 2001518140 | | 10/2001 | |
| JP | 2006299420 | | 11/2006 | |
| JP | 2007031819 | | 2/2007 | |
| JP | 2007262484 | | 10/2007 | |
| JP | 2008-076297 | * | 4/2008 | G01N 17/02 |
| JP | 2008190022 | | 8/2008 | |
| JP | 2014047384 | | 3/2014 | |
| JP | 2014219222 | | 11/2014 | |
| JP | 2016160515 | | 9/2016 | |
| JP | 2016160516 | | 9/2016 | |
| KR | 940010443 | | 5/1994 | |
| KR | 940010443 | | 10/1994 | |
| KR | 20080014744 | | 2/2008 | |
| KR | 20150023006 | | 3/2015 | |
| RU | 99126709 | | 10/2001 | |
| RU | 2292967 | | 2/2007 | |
| RU | 2299256 | | 5/2007 | |
| RU | 2305022 | | 8/2007 | |
| RU | 2313594 | | 12/2007 | |
| RU | 2008139893 | | 4/2010 | |
| RU | 102550 | | 3/2011 | |
| RU | 2415193 | | 3/2011 | |
| SU | 1306484 | | 4/1987 | |
| WO | 9711205 | | 3/1997 | |
| WO | 9811205 | | 3/1998 | |

(56) References Cited

FOREIGN PATENT DOCUMENTS

| | | |
|---|---|---|
| WO | 0037190 A1 | 6/2000 |
| WO | 0144532 | 6/2001 |
| WO | 2008003504 | 1/2008 |
| WO | 2008016169 | 2/2008 |
| WO | 2009130175 | 10/2009 |
| WO | 2013133960 | 9/2013 |
| WO | 2016090026 | 6/2016 |

OTHER PUBLICATIONS

PCT/US2017/053737, International Search Report and Written Opinion, dated Dec. 13, 2017, 16 pages.
Prince, "The effects of dispersoids upon the micromechanisms of crack propagation in Al Mg Si alloys", Acta Mett. (1979) vol. 27, 1401-08.
Zhao et al., "Effect of Mn contents on the bake hardenability and bendability of Al-0.6mass%Mg-0.8mass%Si alloy sheets", J. Jpn. Inst. Light Metal. 55( 5) 2005 227-232.
Australian Application No. 2017350513, "First Examination Report", dated Aug. 29, 2019, 3 pages.
European Application No. 17790884.5 , "Office Action", dated Mar. 16, 2020, 5 pages.
Russian Application No. 2019112632 , "Notice of Decision to Grant", dated Apr. 17, 2020, 14 pages.
Russian Application No. 2019112632 , "Office Action", dated Jan. 21, 2020, 11 pages.
Japanese Application No. P2019-520567, "Office Action", dated May 26, 2020, 9 pages.
European Application No. 17790884.5, Office Action, dated Nov. 26, 2020, 6 pages.
Indian Application No. 201917016394, "First Examination Report", dated Dec. 14, 2020, 7 pages.
Korean Application No. 10-2019-7014950 , Notice of Decision to Grant, dated Jan. 11, 2021, 4 pages.
Australian Application No. 2017350513 , "Notice of Acceptance", dated Feb. 26, 2020, 3 pages.
Canadian Application No. 3,041,580, Office Action, dated Jul. 7, 2020, 5 pages.
Chinese Application No. 201780066634.9, Office Action, dated Aug. 14, 2020, 21 pages.
European Application No. 17790884.5, Office Action, dated Jul. 27, 2020, 6 pages.
Korean Application No. 10-2019-7014950, Office Action, dated Jul. 28, 2020, 7 pages.
Song et al., "The Role of Tin in the Hot-Ductility Deterioration of a Low-Carbon Steel", Metallurgical and Materials Transactions A, vol. 34, No. 8, Aug. 2003, pp. 1611-1616.
Canadian Application No. 3,041,580, Office Action, dated Feb. 1, 2021, 4 pages.
Chinese Application No. 201780066634.9, Office Action, dated Apr. 6, 2021, 8 pages.
Chinese Application No. 201780066634.9, "Supplementary Search Report", dated Mar. 30, 2021, 1 page.
European Application No. 17790884.5, Office Action, ated Apr. 22, 2021, 6 pages.
Japanese Application No. JP2019-520567, Office Action, dated Feb. 2, 2021, 8 pages.
Brazilian Application No. 112019007283-7 , Office Action, dated Jul. 27, 2021, 5 pages.
Canadian Application No. 3,041,580 , Office Action, dated Aug. 18, 2021, 4 pages.
Chinese Application No. 201780066634.9 , Office Action, dated Sep. 24, 2021, 10 pages.
European Application No. 17790884.5, Notice of Decision to Grant, dated Nov. 25, 2021, 2 pages.
Li et al., "Aluminum Alloy Material and Heat Treatment Process", Metallurgical Industry Press, Apr. 30, 2012, pp. 349-353.
Tong et al., "5000 Questions on New Technology of Energy Saving and Emission Reduction in Steel Works", China Science and Technology Press, Jul. 31, 2009, 4 pages.
Wang et al., "Introduction to Constructive Material Science", Shanghai Science and Technology Press, Feb. 28, 1987, p. 97.
Chinese Application No. 201780066634.9 , Office Action, dated Dec. 27, 2021, 10 pages.
Canadian Application No. 3,041,580 , Office Action, dated Mar. 9, 2022, 4 pages.
Chinese Application No. 201780066634.9 , Office Action, dated May 30, 2022, 8 pages.
Japanese Application No. 2019-520567 , Notice of Decision to Grant, dated Apr. 26, 2022, 2 pages.
Mexican Application No. MX/A/2019/004835 , Office Action, dated Apr. 19, 2022, 9 pages.
Canadian Application No. 3,041,580, "Office Action", dated Oct. 21, 2022, 4 pages.
Chinese Application No. 201780066634.9 , "Notice of Decision to Grant", dated Aug. 24, 2022, 5 pages.
Davis , "Aluminum and Aluminum Alloys", ASM International, 1993, pp. 300-303.
Mexican Application No. MX/A/2019/004835 , "Notice of Allowance", dated Sep. 2, 2022, 2 pages.

* cited by examiner

HIGH STRENGTH 7XXX SERIES ALUMINUM ALLOYS AND METHODS OF MAKING THE SAME

CROSS-REFERENCE TO RELATED APPLICATIONS

This application claims the benefit of U.S. Provisional Application Nos. 62/413,764, filed Oct. 27, 2016 and titled "HIGH STRENGTH 7XXX SERIES ALUMINUM ALLOY AND METHODS OF MAKING THE SAME"; 62/529,028, filed Jul. 6, 2017 and titled "SYSTEMS AND METHODS FOR MAKING ALUMINUM ALLOY PLATES"; 62/413,591, filed Oct. 27, 2016 and titled "DECOUPLED CONTINUOUS CASTING AND ROLLING LINE"; and 62/505,944, filed May 14, 2017 and titled "DECOUPLED CONTINUOUS CASTING AND ROLLING LINE", the contents of all of which are incorporated herein by reference in their entireties.

Additionally, the present application is related to U.S. Non-Provisional patent application Ser. No. 15/717,361 to Milan Felberbaum et al., entitled "METAL CASTING AND ROLLING LINE" filed Sep. 27, 2017, the disclosure of which is hereby incorporated by reference in its entirety.

FIELD

The present disclosure relates to the fields of materials science, materials chemistry, metal manufacturing, aluminum alloys, and aluminum manufacturing.

BACKGROUND

Aluminum (Al) alloys are increasingly replacing steel and other metals in multiple applications, such as automotive, transportation, industrial, or electronics-related applications. In some applications, such alloys may need to exhibit high strength, high formability, corrosion resistance, and/or low weight. However, producing alloys having the aforementioned properties is a challenge, as conventional methods and compositions may not achieve the necessary requirements, specifications, and/or performances required for the different applications when produced via established methods. For example, aluminum alloys with a high solute content, including copper (Cu), magnesium (Mg), and zinc (Zn), can lead to cracking when cast.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Provided herein are aluminum alloys that exhibit high strength and high formability, and that do not exhibit cracking during and/or after casting, along with methods of making and processing the alloys. The alloys can be used in automotive, transportation, aerospace, industrial, and electronics applications, to name a few.

In some examples, a method of producing an aluminum alloy product comprises continuously casting an aluminum alloy to form a slab, wherein the aluminum alloy comprises about 0.03-1.2 wt. % Si, 0.06-1.5 wt. % Fe, 0.04-6.0 wt. % Cu, 0.005-0.9 wt. % Mn, 0.7-8.7 wt. % Mg, 0-0.3 wt. % Cr, 1.7-18.3 wt. % Zn, 0.005-0.6 wt. % Ti, 0.001-0.4 wt. % Zr, and up to 0.15 wt. % of impurities, with the remainder Al, and hot rolling the slab to a final gauge without cold rolling the slab prior to the final gauge. In some cases, the aluminum alloy comprises about 0.06-0.35 wt. % Si, 0.12-0.45 wt. % Fe, 1.0-3.0 wt. % Cu, 0.01-0.25 wt. % Mn, 1.5-5.0 wt. % Mg, 0.01-0.25 wt. % Cr, 3.5-15.5 wt. % Zn, 0.01-0.15 wt. % Ti, 0.001-0.18 wt. % Zr, and up to 0.15 wt. % of impurities, with the remainder Al. In some examples, the aluminum alloy comprises about 0.07-0.13 wt. % Si, 0.16-0.22 wt. % Fe, 1.3-2.0 wt. % Cu, 0.01-0.08 wt. % Mn, 2.3-2.65 wt. % Mg, 0.02-0.2 wt. % Cr, 5.0-10.0 wt. % Zn, 0.015-0.04 wt. % Ti, 0.001-0.15 wt. % Zr, and up to 0.15 wt. % of impurities, with the remainder Al. In some cases, the method further includes cooling the slab upon exit from a continuous caster that continuously cast the slab. The cooling step can include quenching the slab with water or air cooling the slab. Optionally, the continuously cast slab is coiled before the step of hot rolling the slab. In some examples, the method can further include coiling the slab into an intermediate coil before hot rolling the slab to the final gauge, pre-heating the intermediate coil before hot rolling the slab to the final gauge, and/or homogenizing the intermediate coil before hot rolling the slab to the final gauge. Optionally, the method further includes solutionizing the aluminum alloy product of the final gauge, quenching the aluminum alloy product of the final gauge, and aging the aluminum alloy product of the final gauge. In some cases, a cold rolling step is not performed. In some examples, the slab is devoid of cracks having a length greater than about 8.0 mm after the continuously cast and before the hot rolling.

In some examples, a method of producing an aluminum alloy product comprises continuously casting an aluminum alloy to form a slab, wherein the aluminum alloy comprises about 0.03-1.2 wt. % Si, 0.06-1.5 wt. % Fe, 0.04-6.0 wt. % Cu, 0.005-0.9 wt. % Mn, 0.7-8.7 wt. % Mg, 0-0.3 wt. % Cr, 1.7-18.3 wt. % Zn, 0.005-0.6 wt. % Ti, 0.001-0.4 wt. % Zr, and up to 0.15 wt. % of impurities, with the remainder Al and hot rolling the slab to a final gauge and a final temper. In some cases, the aluminum alloy comprises about 0.06-0.35 wt. % Si, 0.12-0.45 wt. % Fe, 1.0-3.0 wt. % Cu, 0.01-0.25 wt. % Mn, 1.5-5.0 wt. % Mg, 0.01-0.25 wt. % Cr, 3.5-15.5 wt. % Zn, 0.01-0.15 wt. % Ti, 0.001-0.18 wt. % Zr, and up to 0.15 wt. % of impurities, with the remainder Al. In some examples, the aluminum alloy comprises about 0.07-0.13 wt. % Si, 0.16-0.22 wt. % Fe, 1.3-2.0 wt. % Cu, 0.01-0.08 wt. % Mn, 2.3-2.65 wt. % Mg, 0.02-0.2 wt. % Cr, 5.0-10.0 wt. % Zn, 0.015-0.04 wt. % Ti, 0.001-0.15 wt. % Zr, and up to 0.15 wt. % of impurities, with the remainder Al. In some cases, the cast slab does not exhibit cracking during and/or after casting. In some cases, the slab is devoid of cracks having a length greater than about 8.0 mm after the continuously casting step and before the hot rolling step. Optionally, a cold rolling step is not performed.

Also provided herein are aluminum alloy products prepared according to the methods described herein. The aluminum alloy product can be an aluminum alloy sheet, an aluminum alloy plate, or an aluminum alloy shate. The aluminum alloy product can comprise a long traverse tensile yield strength of at least 560 MPa when in a T6 temper. Optionally, the aluminum alloy product can comprise a bend angle of from about 80° to about 120° when in a T6 temper.

Optionally, the aluminum alloy product can comprise a yield strength of from about 500 MPa to about 650 MPa when in a T4 temper and after paint baking. The aluminum alloy product can optionally be an automotive body part, a motor vehicle part, a transportation body part, an aerospace body part, or an electronics housing.

Other objects and advantages of the invention will be apparent from the following detailed description of embodiments of the invention.

DETAILED DESCRIPTION

Figure 1:
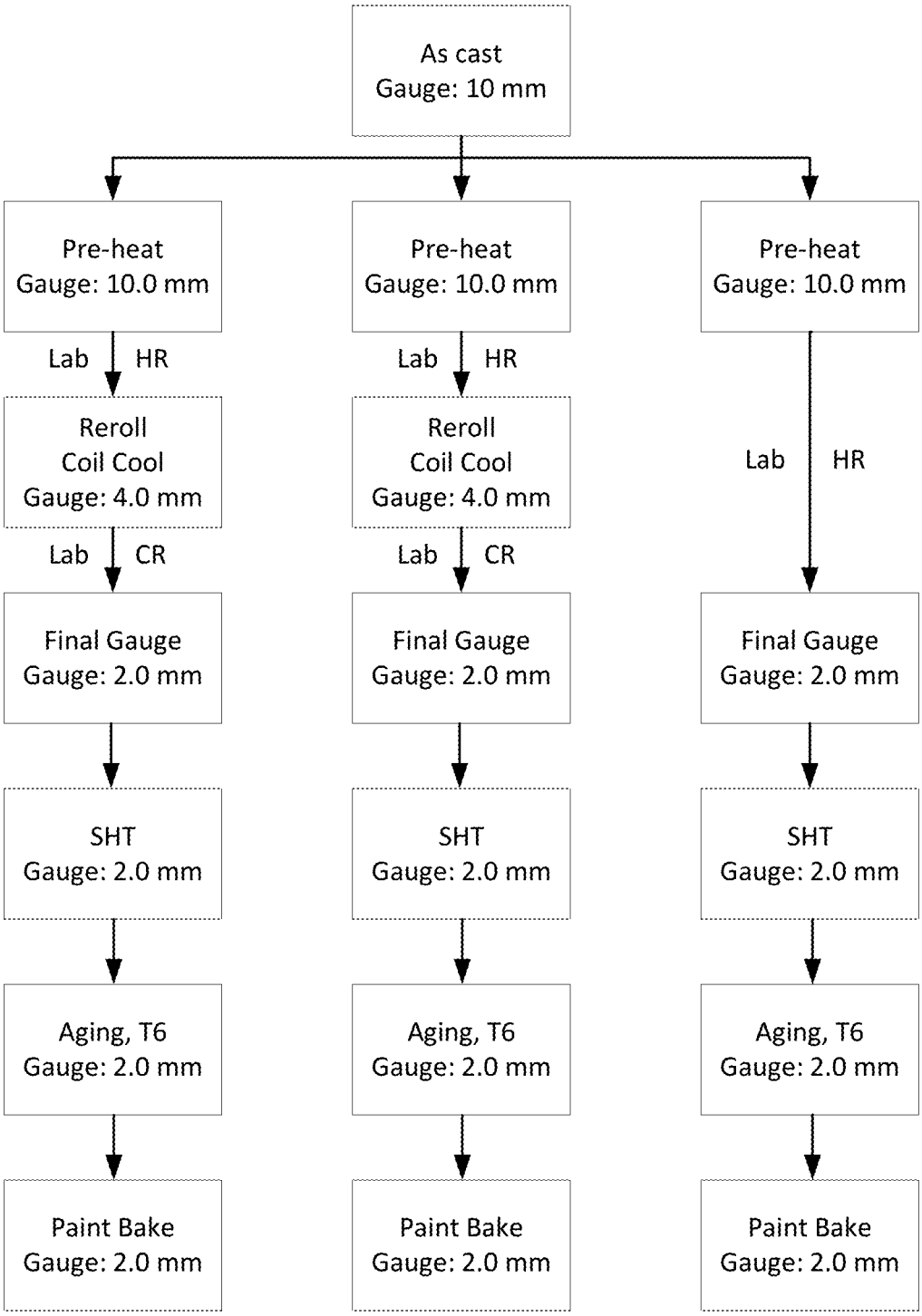
FIG. 1 is a process flow chart showing three different processing routes for different alloys described herein. The right processing route does not include a cold rolling step, while the center and left comparative processing routes include a cold rolling step.

Described herein are 7xxx series aluminum alloys which exhibit high strength and high formability. In some cases, 7xxx series aluminum alloys can be difficult to cast using conventional casting processes due to their high solute content. Methods described herein can permit the casting of 7xxx alloys described herein in thin slabs (e.g., aluminum alloy bodies with a thickness of from about 5 mm to about 50 mm), free from cracking during and/or after casting as determined by visual inspection (e.g., there are fewer cracks per square meter in the slab prepared according to methods described herein than in a direct chill cast ingot). In some examples, 7xxx series aluminum alloys can be continuously cast according to methods as described herein. In some further examples, by including a water quenching step upon exit from the caster, the solutes can freeze in the matrix, rather than precipitating out of the matrix. In some cases, the freezing of the solute can prevent coarsening of the precipitates in downstream processing.

Definitions and Descriptions

The terms "invention," "the invention," "this invention" and "the present invention," as used in this document, are intended to refer broadly to all of the subject matter of this patent application and the claims below. Statements containing these terms should be understood not to limit the subject matter described herein or to limit the meaning or scope of the patent claims below.

As used herein, the meaning of "a," "an," and "the" includes singular and plural references unless the context clearly dictates otherwise.

As used herein, the meaning of "metals" includes pure metals, alloys and metal solid solutions unless the context clearly dictates otherwise.

In this description, reference is made to alloys identified by AA numbers and other related designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T1 condition or temper refers to an aluminum alloy after cooling from hot working and natural aging (e.g., at room temperature). A T2 condition or temper refers to an aluminum alloy after cooling from hot working, cold working, and natural aging. A T3 condition or temper refers to an aluminum alloy after solution heat treatment (i.e., solutionization), cold working, and natural aging. A T4 condition or temper refers to an aluminum alloy after solution heat treatment followed by natural aging. A T5 condition or temper refers to an aluminum alloy after cooling from hot working and artificial aging. A T6 condition or temper refers to an aluminum alloy after solution heat treatment followed by artificial aging (AA). A T7 condition or temper refers to an aluminum alloy after solution heat treatment and then artificially overaging. A T8x condition or temper refers to an aluminum alloy after solution heat treatment, followed by cold working and then by artificial aging. A T9 condition or temper refers to an aluminum alloy after solution heat treatment, followed by artificial aging, and then by cold working. A W condition or temper refers to an aluminum alloy that ages at room temperature after solution heat treatment.

As used herein, a plate generally has a thickness of greater than about 15 mm. For example, a plate may refer to an aluminum product having a thickness of greater than 15 mm, greater than 20 mm, greater than 25 mm, greater than 30 mm, greater than 35 mm, greater than 40 mm, greater than 45 mm, greater than 50 mm, or greater than 100 mm. As used herein, a shate (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a sheet generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

In the following examples, the aluminum alloys are described in terms of their elemental composition in weight percentage (wt. %) of the whole. In each alloy, the remainder is aluminum with a maximum wt. % of 0.15 wt. % for all impurities.

Alloy Composition

The alloys described herein are aluminum-containing 7xxx series alloys. The alloys exhibit unexpectedly high strength and high formability. In some cases, the properties of the alloys can be achieved due to the elemental composition of the alloys. The alloys can have the following elemental composition as provided in Table 1.

TABLE 1

| Element | Weight Percentage (wt. %) |
|---|---|
| Si | 0.03-1.2 |
| Fe | 0.06-1.5 |
| Cu | 0.04-6.0 |
| Mn | 0.005-0.9 |
| Mg | 0.7-8.7 |
| Cr | 0-0.3 |

TABLE 1-continued

| Element | Weight Percentage (wt. %) |
|---|---|
| Zn | 1.7-18.3 |
| Ti | 0.005-0.6 |
| Zr | 0-0.4 |
| Impurities | 0.05 (each)<br>0.15 (total) |
| Al | Remainder |

In some examples, the alloy can have an elemental composition as provided in Table 2.

TABLE 2

| Element | Weight Percentage (wt. %) |
|---|---|
| Si | 0.06-0.35 |
| Fe | 0.12-0.45 |
| Cu | 1.0-3.0 |
| Mn | 0.01-0.25 |
| Mg | 1.5-5.0 |
| Cr | 0.01-0.25 |
| Zn | 3.5-15.5 |
| Ti | 0.01-0.15 |
| Zr | 0.001-0.18 |
| Impurities | 0.05 (each)<br>0.15 (total) |
| Al | Remainder |

In some examples, the alloy can have an elemental composition as provided in Table 3.

TABLE 3

| Element | Weight Percentage (wt. %) |
|---|---|
| Si | 0.07-0.13 |
| Fe | 0.16-0.22 |
| Cu | 1.3-2.0 |
| Mn | 0.01-0.08 |
| Mg | 2.3-2.65 |
| Cr | 0.02-0.2 |
| Zn | 5.0-10.0 |
| Ti | 0.015-0.04 |
| Zr | 0.001-0.15 |
| Impurities | 0.05 (each)<br>0.15 (total) |
| Al | Remainder |

In some examples, the alloy described herein includes silicon (Si) in an amount of from about 0.03 wt. % to about 1.20 wt. % (e.g., from about 0.06 wt. % to about 0.35 wt. % or from about 0.07 wt. % to about 0.13 wt. %) based on the total weight of the alloy. For example, the alloy can include 0.03 wt. %, 0.04 wt. %, 0.05 wt. %, 0.06 wt. %, 0.07 wt. %, 0.08 wt. %, 0.09 wt. %, 0.10 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.30 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.40 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.50 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.60 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.70 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.80 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, 0.90 wt. %, 0.91 wt. %, 0.92 wt. %, 0.93 wt. %, 0.94 wt. %, 0.95 wt. %, 0.96 wt. %, 0.97 wt. %, 0.98 wt. %, 0.99 wt. %, 1.00 wt. %, 1.01 wt. %, 1.02 wt. %, 1.03 wt. %, 1.04 wt. %, 1.05 wt. %, 1.06 wt. %, 1.07 wt. %, 1.08 wt. %, 1.09 wt. %, 1.10 wt. %, 1.11 wt. %, 1.12 wt. %, 1.13 wt. %, 1.14 wt. %, 1.15 wt. %, 1.16 wt. %, 1.17 wt. %, 1.18 wt. %, 1.19 wt. %, or 1.20 wt. % Si.

In some examples, the alloy described herein also includes iron (Fe) in an amount of from about 0.06 wt. % to about 1.50 wt. % (e.g., from about 0.12 wt. % to about 0.45 wt. % or from about 0.16 wt. % to about 0.22 wt. %) based on the total weight of the alloy. For example, the alloy can include 0.06 wt. %, 0.07 wt. %, 0.08 wt. %, 0.09 wt. %, 0.10 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.20 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.30 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.40 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.50 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.60 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.70 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.80 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, 0.90 wt. %, 0.91 wt. %, 0.92 wt. %, 0.93 wt. %, 0.94 wt. %, 0.95 wt. %, 0.96 wt. %, 0.97 wt. %, 0.98 wt. %, 0.99 wt. %, 1.00 wt. %, 1.01 wt. %, 1.02 wt. %, 1.03 wt. %, 1.04 wt. %, 1.05 wt. %, 1.06 wt. %, 1.07 wt. %, 1.08 wt. %, 1.09 wt. %, 1.10 wt. %, 1.11 wt. %, 1.12 wt. %, 1.13 wt. %, 1.14 wt. %, 1.15 wt. %, 1.16 wt. %, 1.17 wt. %, 1.18 wt. %, 1.19 wt. %, 1.20 wt. %, 1.21 wt. %, 1.22 wt. %, 1.23 wt. %, 1.24 wt. %, 1.25 wt. %, 1.26 wt. %, 1.27 wt. %, 1.28 wt. %, 1.29 wt. %, 1.30 wt. %, 1.31 wt. %, 1.32 wt. %, 1.33 wt. %, 1.34 wt. %, 1.35 wt. %, 1.36 wt. %, 1.37 wt. %, 1.38 wt. %, 1.39 wt. %, 1.40 wt. %, 1.41 wt. %, 1.42 wt. %, 1.43 wt. %, 1.44 wt. %, 1.45 wt. %, 1.46 wt. %, 1.47 wt. %, 1.48 wt. %, 1.49 wt. %, or 1.50 wt. % Fe.

In some examples, the alloy described herein includes copper (Cu) in an amount of from about 0.04 wt. % to about 6.0 wt. % (e.g., from about 1.0 wt. % to about 3.0 wt. % or from about 1.3 wt. % to about 2.0 wt. %) based on the total weight of the alloy. For example, the alloy can include 0.04 wt. %, 0.05 wt. %, 0.06 wt. %, 0.07 wt. %, 0.08 wt. %, 0.09 wt. %, 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1.0 wt. %, 1.1 wt. %, 1.2 wt. %, 1.3 wt. %, 1.4 wt. %, 1.5 wt. %, 1.6 wt. %, 1.7 wt. %, 1.8 wt. %, 1.9 wt. %, 2.0 wt. %, 2.1 wt. %, 2.2 wt. %, 2.3 wt. %, 2.4 wt. %, 2.5 wt. %, 2.6 wt. %, 2.7 wt. %, 2.8 wt. %, 2.9 wt. %, 3.0 wt. %, 3.1 wt. %, 3.2 wt. %, 3.3 wt. %, 3.4 wt. %, 3.5 wt. %, 3.6 wt. %, 3.7 wt. %, 3.8 wt. %, 3.9 wt. %, 4.0 wt. %, 4.1 wt. %, 4.2 wt. %, 4.3 wt. %, 4.4 wt. %, 4.5 wt. %, 4.6 wt. %, 4.7 wt. %, 4.8 wt. %, 4.9 wt. %, 5.0 wt. %, 5.1 wt. %, 5.2 wt. %, 5.3 wt. %, 5.4 wt. %, 5.5 wt. %, 5.6 wt. %, 5.7 wt. %, 5.8 wt. %, 5.9 wt. %, or 6.0 wt. % Cu.

In some examples, the alloy described herein can include manganese (Mn) in an amount of from about 0.005 wt. % to about 0.9 wt. % (e.g., from about 0.01 wt. % to about 0.25 wt. % or from about 0.01 wt. % to about 0.08 wt. %) based on the total weight of the alloy. For example, the alloy can include 0.005 wt. %, 0.006 wt. %, 0.007 wt. %, 0.008 wt. %, 0.009 wt. %, 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.2 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.4 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.5 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, 0.6 wt. %, 0.61 wt. %, 0.62 wt. %, 0.63 wt. %, 0.64 wt. %, 0.65 wt. %, 0.66 wt. %, 0.67 wt. %, 0.68 wt. %, 0.69 wt. %, 0.7 wt. %, 0.71 wt. %, 0.72 wt. %, 0.73 wt. %, 0.74 wt. %, 0.75 wt. %, 0.76 wt. %, 0.77 wt. %, 0.78 wt. %, 0.79 wt. %, 0.8 wt. %, 0.81 wt. %, 0.82 wt. %, 0.83 wt. %, 0.84 wt. %, 0.85 wt. %, 0.86 wt. %, 0.87 wt. %, 0.88 wt. %, 0.89 wt. %, or 0.9 wt. % Mn.

Magnesium (Mg) can be included in the alloys described herein to serve as a solid solution strengthening element for the alloy. The alloy described herein can include Mg in an amount of from 0.7 wt. % to 8.7 wt. % (e.g., from about 1.5 wt. % to about 5.0 wt. % or from about 2.3 wt. % to about 2.65 wt. %). In some examples, the alloy can include 0.7 wt. %, 0.8 wt. %, 0.9 wt. %, 1.0 wt. %, 1.1 wt. %, 1.2 wt. %, 1.3 wt. %, 1.4 wt. %, 1.5 wt. %, 1.6 wt. %, 1.7 wt. %, 1.8 wt. %, 1.9 wt. %, 2.0 wt. %, 2.1 wt. %, 2.2 wt. %, 2.3 wt. %, 2.4 wt. %, 2.5 wt. %, 2.6 wt. %, 2.7 wt. %, 2.8 wt. %, 2.9 wt. %, 3.0 wt. %, 3.1 wt. %, 3.2 wt. %, 3.3 wt. %, 3.4 wt. %, 3.5 wt. %, 3.6 wt. %, 3.7 wt. %, 3.8 wt. %, 3.9 wt. %, 4.0 wt. %, 4.1 wt. %, 4.2 wt. %, 4.3 wt. %, 4.4 wt. %, 4.5 wt. %, 4.6 wt. %, 4.7 wt. %, 4.8 wt. %, 4.9 wt. %, 5.0 wt. %, 5.1 wt. %, 5.2 wt. %, 5.3 wt. %, 5.4 wt. %, 5.5 wt. %, 5.6 wt. %, 5.7 wt. %, 5.8 wt. %, 5.9 wt. %, 6.0 wt. %, 6.1 wt. %, 6.2 wt. %, 6.3 wt. %, 6.4 wt. %, 6.5 wt. %, 6.6 wt. %, 6.7 wt. %, 6.8 wt. %, 6.9 wt. %, 7.0 wt. %, 7.1 wt. %, 7.2 wt. %, 7.3 wt. %, 7.4 wt. %, 7.5 wt. %, 7.6 wt. %, 7.7 wt. %, 7.8 wt. %, 7.9 wt. %, 8.0 wt. %, 8.1 wt. %, 8.2 wt. %, 8.3 wt. %, 8.4 wt. %, 8.5 wt. %, 8.6 wt. %, or 8.7 wt. % Mg.

In some examples, the alloy described herein includes chromium (Cr) in an amount of up to about 0.3 wt. % (e.g., from about 0.01 wt. % to about 0.25 wt. % or from about 0.02 wt. % to about 0.2 wt. %) based on the total weight of the alloy. For example, the alloy can include 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.2 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, or 0.3 wt. % Cr. In certain aspects, Cr is not present in the alloy (i.e., 0 wt. %).

In some examples, the alloy described herein includes zinc (Zn) in an amount of from about 1.7 wt. % to about 18.3 wt. % (e.g., from about 3.5 wt. % to about 15.5 wt. % or from about 5.0 wt. % to about 10.0 wt. %) based on the total weight of the alloy. For example, the alloy can include 1.7 wt. %, 1.8 wt. %, 1.9 wt. %, 2.0 wt. %, 2.1 wt. %, 2.2 wt. %, 2.3 wt. %, 2.4 wt. %, 2.5 wt. %, 2.6 wt. %, 2.7 wt. %, 2.8 wt. %, 2.9 wt. %, 3.0 wt. %, 3.1 wt. %, 3.2 wt. %, 3.3 wt. %, 3.4 wt. %, 3.5 wt. %, 3.6 wt. %, 3.7 wt. %, 3.8 wt. %, 3.9 wt. %, 4.0 wt. %, 4.1 wt. %, 4.2 wt. %, 4.3 wt. %, 4.4 wt. %, 4.5 wt. %, 4.6 wt. %, 4.7 wt. %, 4.8 wt. %, 4.9 wt. %, 5.0 wt. %, 5.1 wt. %, 5.2 wt. %, 5.3 wt. %, 5.4 wt. %, 5.5 wt. %, 5.6 wt. %, 5.7 wt. %, 5.8 wt. %, 5.9 wt. %, 6.0 wt. %, 6.1 wt. %, 6.2 wt. %, 6.3 wt. %, 6.4 wt. %, 6.5 wt. %, 6.6 wt. %, 6.7 wt. %, 6.8 wt. %, 6.9 wt. %, 7.0 wt. %, 7.1 wt. %, 7.2 wt. %, 7.3 wt. %, 7.4 wt. %, 7.5 wt. %, 7.6 wt. %, 7.7 wt. %, 7.8 wt. %, 7.9 wt. %, 8.0 wt. %, 8.1 wt. %, 8.2 wt. %, 8.3 wt. %, 8.4 wt. %, 8.5 wt. %, 8.6 wt. %, 8.7 wt. %, 8.8 wt. %, 8.9 wt. %, 9.0 wt. %, 9.1 wt. %, 9.2 wt. %, 9.3 wt. %, 9.4 wt. %, 9.5 wt. %, 9.6 wt. %, 9.7 wt. %, 9.8 wt. %, 9.9 wt. %, 10.0 wt. %, 10.1 wt. %, 10.2 wt. %, 10.3 wt. %, 10.4 wt. %, 10.5 wt. %, 10.6 wt. %, 10.7 wt. %, 10.8 wt. %, 10.9 wt. %, 11.0 wt. %, 11.1 wt. %, 11.2 wt. %, 11.3 wt. %, 11.4 wt. %, 11.5 wt. %, 11.6 wt. %, 11.7 wt. %, 11.8 wt. %, 11.9 wt. %, 12.0 wt. %, 12.1 wt. %, 12.2 wt. %, 12.3 wt. %, 12.4 wt. %, 12.5 wt. %, 12.6 wt. %, 12.7 wt. %, 12.8 wt. %, 12.9 wt. %, 13.0 wt. %, 13.1 wt. %, 13.2 wt. %, 13.3 wt. %, 13.4 wt. %, 13.5 wt. %, 13.6 wt. %, 13.7 wt. %, 13.8 wt. %, 13.9 wt. %, 14.0 wt. %, 14.1 wt. %, 14.2 wt. %, 14.3 wt. %, 14.4 wt. %, 14.5 wt. %, 14.6 wt. %, 14.7 wt. %, 14.8 wt. %, 14.9 wt. %, 15.0 wt. %, 15.1 wt. %, 15.2 wt. %, 15.3 wt. %, 15.4 wt. %, 15.5 wt. %, 15.6 wt. %, 15.7 wt. %, 15.8 wt. %, 15.9 wt. %, 16.0 wt. %, 16.1 wt. %, 16.2 wt. %, 16.3 wt. %, 16.4 wt. %, 16.5 wt. %, 16.6 wt. %, 16.7 wt. %, 16.8 wt. %, 16.9 wt. %, 17.0 wt. %, 17.1 wt. %, 17.2 wt. %, 17.3 wt. %, 17.4 wt. %, 17.5 wt. %, 17.6 wt. %, 17.7 wt. %, 17.8 wt. %, 17.9 wt. %, 18.0 wt. %, 18.1 wt. %, 18.2 wt. %, or 18.3 wt. % Zn.

In some examples, the alloy described herein includes titanium (Ti) in an amount of from about 0.005 wt. % to about 0.60% (e.g., from about 0.01 wt. % to about 0.15 wt. % or from about 0.015 wt. % to about 0.04 wt. %) based on the total weight of the alloy. For example, the alloy can include 0.005 wt. %, 0.006 wt. %, 0.007 wt. %, 0.008 wt. %, 0.009 wt. %, 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.2 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, 0.4 wt. %, 0.41 wt. %, 0.42 wt. %, 0.43 wt. %, 0.44 wt. %, 0.45 wt. %, 0.46 wt. %, 0.47 wt. %, 0.48 wt. %, 0.49 wt. %, 0.5 wt. %, 0.51 wt. %, 0.52 wt. %, 0.53 wt. %, 0.54 wt. %, 0.55 wt. %, 0.56 wt. %, 0.57 wt. %, 0.58 wt. %, 0.59 wt. %, or 0.6 wt. % Ti.

In some examples, the alloy described herein includes zirconium (Zr) in an amount of up to about 0.4% (e.g., from about 0.001 wt. % to about 0.4%, from about 0.001 wt. % to about 0.18 wt. % or from about 0.001 wt. % to about 0.15 wt. %) based on the total weight of the alloy. For example, the alloy can include 0.001 wt. %, 0.002 wt. %, 0.003 wt. %, 0.004 wt. %, 0.005 wt. %, 0.006 wt. %, 0.007 wt. %, 0.008 wt. %, 0.009 wt. %, 0.01 wt. %, 0.02 wt. %, 0.03 wt. %, 0.04 wt. %, 0.05 wt. %, 0.06 wt. %, 0.07 wt. %, 0.08 wt. %, 0.09 wt. %, 0.1 wt. %, 0.11 wt. %, 0.12 wt. %, 0.13 wt. %, 0.14 wt. %, 0.15 wt. %, 0.16 wt. %, 0.17 wt. %, 0.18 wt. %, 0.19 wt. %, 0.2 wt. %, 0.21 wt. %, 0.22 wt. %, 0.23 wt. %, 0.24 wt. %, 0.25 wt. %, 0.26 wt. %, 0.27 wt. %, 0.28 wt. %, 0.29 wt. %, 0.3 wt. %, 0.31 wt. %, 0.32 wt. %, 0.33 wt. %, 0.34 wt. %, 0.35 wt. %, 0.36 wt. %, 0.37 wt. %, 0.38 wt. %, 0.39 wt. %, or 0.4 wt. % Zr. In certain aspects, Zr is not present in the alloy (i.e., 0 wt. %).

Optionally, the alloy compositions described herein can further include other minor elements, sometimes referred to as impurities, in amounts of 0.05 wt. % or below, 0.04 wt. % or below, 0.03 wt. % or below, 0.02 wt. % or below, or 0.01 wt. % or below each. These impurities may include, but are not limited to, V, Ni, Sn, Ga, Ca, or combinations thereof. Accordingly, V, Ni, Sn, Ga, or Ca may be present in alloys in amounts of 0.05 wt. % or below, 0.04 wt. % or below, 0.03 wt. % or below, 0.02 wt. % or below, or 0.01 wt. % or below. In some examples, the sum of all impurities does not exceed 0.15 wt. % (e.g., 0.10 wt. %). The remaining percentage of the alloy is aluminum.

Optionally, the aluminum alloy as described herein can be a 7xxx aluminum alloy according to one of the following aluminum alloy designations: AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7041, AA7049, AA7049A, AA7149, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, and AA7099.

Methods of Making

Methods of producing an aluminum sheet are also described herein. The aluminum alloy can be cast and then further processing steps may be performed. In some examples, the processing steps include an optional quenching step, a pre-heating and/or a homogenizing step, a hot rolling step, a solutionizing step, an artificial aging step, an optional coating step and an optional paint baking step.

In some examples, the method comprises casting a slab; hot rolling the slab to produce a hot rolled aluminum alloy in a form of a sheet, shate or plate; solutionizing the aluminum sheet, shate or plate; and aging the aluminum sheet, shate or plate. In some examples, the hot rolling step includes hot rolling the slab to a final gauge and/or a final temper. In some examples, a cold rolling step is eliminated (i.e., excluded). In some examples, the slabs are thermally quenched upon exit from the continuous caster. In some further examples, the slabs are coiled upon exit from the continuous caster. In some cases, the coiled slabs are cooled in air. In some instances, the method further includes pre-heating the coiled slabs. In some instances, the method further includes coating the aged aluminum sheet, shate, or plate. In some further instances, the method further includes baking the coated aluminum sheet, shate, or plate. The method steps are further described below.

Casting

The alloys described herein can be cast into slabs using a continuous casting (CC) process. The continuous casting device can be any suitable continuous casting device. The CC process can include, but is not limited to, the use of block casters, twin roll casters or twin belt casters. Surprisingly desirable results have been achieved using a twin belt casting device, such as the belt casting device described in U.S. Pat. No. 6,755,236 entitled "BELT-COOLING AND GUIDING MEANS FOR CONTINUOUS BELT CASTING OF METAL STRIP," the disclosure of which is hereby incorporated by reference in its entirety. In some examples, especially desirable results can be achieved by using a belt casting device having belts made from a metal having a high thermal conductivity, such as copper. The belt casting device can include belts made from a metal having a thermal conductivity of up to 400 Watts per meter per degree Kelvin (W/m·K). For example, the belt conductivity can be 50 W/m·K, 100 W/m·K, 150 W/m·K, 250 W/m·K, 300 W/m·K, 325 W/m·K, 350 W/m·K, 375 W/m·K, or 400 W/m·K at casting temperatures, although metals having other values of thermal conductivity may be used, including carbon-steel, or low-carbon steel. The CC can be performed at rates up to about 12 meters/minute (m/min). For example, the CC can be performed at a rate of 12 m/min or less, 11 m/min or less, 10 m/min or less, 9 m/min or less, 8 m/min or less, 7 m/min or less, 6 m/min or less, 5 m/min or less, 4 m/min or less, 3 m/min or less, 2 m/min or less, or 1 m/min or less.

The resulting slab can have a thickness of about 5 mm to about 50 mm (e.g., from about 10 mm to about 45 mm, from about 15 mm to about 40 mm, or from about 20 mm to about 35 mm), such as about 10 mm. For example, the resulting slab can be 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, 40 mm, 41 mm, 42 mm, 43 mm, 44 mm, 45 mm, 46 mm, 47 mm, 48 mm, 49 mm, or 50 mm thick.

Quenching

The resulting slabs can optionally be thermally quenched upon exit from the continuous caster. In some examples, the quench is performed with water. Optionally, the water quenching step can be performed at a rate of up to about 200° C./s (for example, from 10° C./s to 190° C./s, from 25° C./s to 175° C./s, from 50° C./s to 150° C./s, from 75° C./s to 125° C./s, or from 10° C./s to 50° C./s). The water temperature can be from about 20° C. to about 75° C. (e.g., about 25° C., about 30° C., about 35° C., about 40° C., about 45° C., about 50° C., about 55° C., about 60° C., about 65° C., about 70° C., or about 75° C.). Optionally, the resulting slabs can be coiled upon exit from the continuous caster. The resulting intermediate coil can be cooled in air. The air cooling step can be performed at a rate of about 1° C./s to about 300° C./day.

In some examples, water quenching the slab upon exit from the continuous caster results in an aluminum alloy slab in a T4-temper condition. After the optional water quenching, the slab in T4-temper can then be optionally coiled into an intermediate coil and stored for a time period of up to 24 hours. Unexpectedly, water quenching the slab upon exit from the continuous caster does not result in cracking of the slab as determined by visual inspection such that the slab can be devoid of cracks. For example, as compared to direct chill cast ingots, the cracking tendency of the slabs produced according to the methods described herein is significantly diminished. In some examples, there are about 8 or fewer cracks per square meter having a length less than about 8.0 mm (e.g., about 7 or fewer cracks, about 6 or fewer cracks, about 5 or fewer cracks, about 4 or fewer cracks, about 3 or fewer cracks, about 2 or fewer cracks, or about 1 crack per square meter).

Coiling

Optionally, the slab can be coiled into an intermediate coil upon exit from the continuous caster. In some examples, the slab is coiled into an intermediate coil upon exit from the continuous caster resulting in F-temper. In some further examples, the coil is cooled in air. In some still further examples, the air cooled coil is stored for a period of time. In some examples, the intermediate coils are maintained at a temperature of about 100° C. to about 350° C. (for example, about 200° C. or about 300° C.). In some further examples, the intermediate coils are maintained in cold storage to prevent natural aging resulting in F-temper.

Pre-Heating and/or Homogenizing

When stored, the intermediate coils can be optionally reheated in a pre-heating step. In some examples, the reheating step can include pre-heating the intermediate coils for a hot rolling step. In some further examples, the reheating step can include pre-heating the intermediate coils at a rate of up to about 150° C./h (for example, about 10° C./h or about 50° C./h). The intermediate coils can be heated to a temperature of about 350° C. to about 580° C. (e.g., about 375° C. to about 570° C., about 400° C. to about 550° C., about 425° C. to about 500° C., or about 500° C. to about 580° C.). The intermediate coils can soak for about 1 minute to about 120 minutes, preferably about 60 minutes.

Optionally, the intermediate coils after storage and/or pre-heating of the coils or the slab upon exit from the caster can be homogenized. The homogenization step can include heating the slab or intermediate coil to attain a temperature of from about 300° C. to about 500° C. (e.g., from about 320° C. to about 480° C. or from about 350° C. to about 450° C.). In some cases, the heating rate can be about 150° C./hour or less, 125° C./hour or less, 100° C./hour or less, 75° C./hour or less, 50° C./hour or less, 40° C./hour or less, 30° C./hour or less, 25° C./hour or less, 20° C./hour or less, or 15° C./hour or less. In other cases, the heating rate can be from about 10° C./min to about 100° C./min (e.g., from about 10° C./min to about 90° C./min, from about 10° C./min to about 70° C./min, from about 10° C./min to about 60° C./min, from about 20° C./min to about 90° C./min, from about 30° C./min to about 80° C./min, from about 40° C./min to about 70° C./min, or from about 50° C./min to about 60° C./min).

The coil or slab is then allowed to soak (i.e., held at the indicated temperature) for a period of time. According to one non-limiting example, the coil or slab is allowed to soak for up to about 36 hours (e.g., from about 30 minutes to about 36 hours, inclusively). For example, the coil or slab can be soaked at a temperature for 10 seconds, 15 seconds, 30 seconds, 45 seconds, 1 minute, 2 minutes, 5 minutes, 10 minutes, 15 minutes, 20 minutes, 25 minutes, 30 minutes, 1 hour, 2 hours, 3 hours, 4 hours, 5 hours, 6 hours, 7 hours, 8 hours, 9 hours, 10 hours, 11 hours, 12 hours, 13 hours, 14 hours, 15 hours, 16 hours, 17 hours, 18 hours, 19 hours, 20 hours, 21 hours, 22 hours, 23 hours, 24 hours, 25 hours, 26 hours, 27 hours, 28 hours, 29 hours, 30 hours, 31 hours, 32 hours, 33 hours, 34 hours, 35 hours, 36 hours, or anywhere in between.

Hot Rolling

Following the pre-heating and/or homogenizing step, a hot rolling step can be performed. The hot rolling step can include a hot reversing mill operation and/or a hot tandem mill operation. The hot rolling step can be performed at a temperature ranging from about 250° C. to about 500° C. (e.g., from about 300° C. to about 400° C. or from about 350° C. to about 500° C.). For example, the hot rolling step can be performed at a temperature of about 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., 490° C., or 500° C.

In the hot rolling step, the metal product can be hot rolled to a thickness of a 10 mm gauge or less (e.g., from about 2 mm to about 8 mm). For example, the metal product can be hot rolled to about a 10 mm gauge or less, a 9 mm gauge or less, an 8 mm gauge or less, a 7 mm gauge or less, a 6 mm gauge or less, a 5 mm gauge or less, a 4 mm gauge or less, a 3 mm gauge or less, or a 2 mm gauge or less. In some cases, the percentage reduction in thickness resulting from the hot rolling step can be from about 35% to about 80% (e.g., 35%, 40%, 45%, 50%, 55%, 60%, 65%, 70%, 75%, or 80%). Optionally, the hot rolled metal product is quenched at the end of the hot rolling step (e.g., upon exit from the tandem mill). Optionally, at the end of the hot rolling step, the hot rolled metal product is coiled.

Solutionizing

The hot rolled metal product can then undergo a solutionizing step. The solutionizing step can be performed at a temperature ranging from about 420° C. to about 490° C. (e.g., from about 440° C. to about 480° C. or from about 460° C. to about 470° C.). The solutionizing step can be performed for about 0 minutes to about 1 hours (e.g., for about 1 minutes or for about 30 minutes). Optionally, at the end of the solutionizing step (e.g., upon exit from a furnace), the sheet is subjected to a thermal quenching step. The thermal quenching step can be performed using air and/or water. The water temperature can be from about 20° C. to about 75° C. (e.g., about 25° C. or about 55° C.).

Optionally, the hot rolled metal is provided in a final gauge and/or a final temper. In some non-limiting examples, the hot rolling step can provide a final product having desired mechanical properties such that further downstream processing is not required. For example, the final product can be hot rolled and delivered in a final gauge and temper without any cold rolling, solutionizing, quenching after solutionizing, natural aging, and/or artificial aging. Hot rolling to final gauge and temper, also referred to as "HRTGT", can provide a metal product having optimized mechanical properties at a significantly reduced cost.

Optionally, further processing steps, such as aging, coating, or baking can be performed. These steps are further described below. Optionally, a cold rolling step is not performed (i.e., excluded or eliminated from the process described herein). In some examples, a cold rolling step can increase the strength and hardness of an aluminum alloy while concomitantly decreasing the formability of the aluminum alloy sheet, shate or plate. Eliminating the cold rolling step can preserve the ductility of the aluminum alloy sheet, shate or plate. Unexpectedly, eliminating the cold rolling step does not have an adverse effect on the strength of the aluminum alloys described herein, as will be described in detail in the examples provided herein.

Aging

Optionally, the hot rolled metal is subjected to an artificial aging step. The artificial aging step develops the high strength property of the alloys and optimizes other desirable properties in the alloys. The mechanical properties of the final product can be controlled by various aging conditions depending on the desired use. In some cases, the metal product described herein can be delivered to customers in a Tx temper (a T1 temper, a T4 temper, a T5 temper, a T6 temper, a T7 temper, or a T8 temper, for example), a W temper, an O temper, or an F temper. In some examples, an artificial aging step can be performed. The artificial aging step can be performed at a temperature from about 100° C. to about 140° C. (e.g., at about 120° C. or at about 125° C.). The aging step can be performed for a period of time from about 12 hours to about 36 hours (e.g., for about 18 hours or for about 24 hours). In some examples, the artificial aging step can be performed at 125° C. for 24 hours to result in a T6-temper. In some still further examples, the alloys are subjected to a natural aging step. The natural aging step can result in a T4-temper.

Coating and/or Paint Baking

Optionally, the metal product is subjected to a coating step. Optionally, the coating step can include zinc phosphating (Zn-phosphating) and electrocoating (E-coating). The Zn-phosphating and E-coating are performed according to standards commonly used in the aluminum industry as known to one of skill in the art. Optionally, the coating step can be followed by a paint baking step. The paint baking step can be performed at a temperature of about 150° C. to about 230° C. (e.g., at about 180° C. or at about 210° C.). The paint baking step can be performed for a time period of about 10 minutes to about 60 minutes (e.g., about 30 minutes or about 45 minutes).

Properties

The resulting metal product as described herein has a combination of desired properties, including high strength and high formability under a variety of temper conditions, including Tx-temper conditions (where Tx tempers can include T1, T4, T5, T6, T7, or T8 tempers), W temper, O temper, or F temper. In some examples, the resulting metal product has a yield strength of from approximately 400 to 650 MPa (e.g., from 450 MPa to 625 MPa, from 475 MPa to 600 MPa, or from 500 MPa to 575 MPa). For example, the yield strength can be approximately 400 MPa, 410 MPa, 420 MPa, 430 MPa, 440 MPa, 450 MPa, 460 MPa, 470 MPa, 480 MPa, 490 MPa, 500 MPa, 510 MPa, 520 MPa, 530 MPa, 540 MPa, 550 MPa, 560 MPa, 570 MPa, 580 MPa, 590 MPa, 600 MPa, 610 MPa, 620 MPa, 630 MPa, 640 MPa, or 650 MPa. Optionally, the metal product having a yield strength of between approximately 400 and 650 MPa can be in the T6 temper. In some examples, the resulting metal product has a maximum yield strength of from approximately 560 and 650 MPa. For example, the maximum yield strength of the metal product can be approximately 560 MPa, 570 MPa, 580 MPa, 590 MPa, 600 MPa, 610 MPa, 620 MPa, 630 MPa, 640 MPa, or 650 MPa. Optionally, the metal product having a maximum yield strength of from approximately 560 and 650 MPa can be in the T6 temper. Optionally, the metal product can have a yield strength of from approximately 500 MPa to approximately 650 MPa after paint baking the metal product in the T4 temper (i.e., without any artificial aging).

In some examples, the resulting metal product has an ultimate tensile strength of from approximately 500 to 650 MPa (e.g., from 550 MPa to 625 MPa or from 575 MPa to 600 MPa). For example, the ultimate tensile strength can be approximately 500 MPa, 510 MPa, 520 MPa, 530 MPa, 540 MPa, 550 MPa, 560 MPa, 570 MPa, 580 MPa, 590 MPa, 600 MPa, 610 MPa, 620 MPa, 630 MPa, 640 MPa, or 650 MPa. Optionally, the metal product having an ultimate tensile strength of from approximately 500 to 650 MPa is in the T6 temper.

In some examples, the resulting metal product has a bend angle of from approximately 100° to 160° (e.g., from approximately 110° to 155° or from approximately 120° to 150°). For example, the bend angle of the resulting metal product can be approximately 100°, 101°, 102°, 103°, 104°, 105°, 106°, 107°, 108°, 109°, 110°, 111°, 112°, 113°, 114°, 115°, 116°, 117°, 118°, 119°, 120°, 121°, 122°, 123°, 124°, 125°, 126°, 127°, 128°, 129°, 130°, 131°, 132°, 133°, 134°, 135°, 136°, 137°, 138°, 139°, 140°, 141°, 142°, 143°, 144°, 145°, 146°, 147°, 148°, 149°, 150°, 151°, 152°, 153°, 154°, 155°, 156°, 157°, 158°, 159°, or 160°. Optionally, the metal product having a bend angle of from approximately 100° to 160° can be in the T6 temper.

Methods of Use

The alloys and methods described herein can be used in automotive and/or transportation applications, including motor vehicle, aircraft, and railway applications, or any other desired application. In some examples, the alloys and methods can be used to prepare motor vehicle body part products, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The aluminum alloys and methods described herein can also be used in aircraft or railway vehicle applications, to prepare, for example, external and internal panels.

The alloys and methods described herein can also be used in electronics applications. For example, the alloys and methods described herein can also be used to prepare housings for electronic devices, including mobile phones and tablet computers. In some examples, the alloys can be used to prepare housings for the outer casing of mobile phones (e.g., smart phones) and tablet bottom chassis.

In some cases, the alloys and methods described herein can be used in industrial applications. For example, the alloys and methods described herein can be used to prepare products for the general distribution market.

Reference has been made in detail to various examples of the disclosed subject matter, one or more examples of which were set forth above. Each example was provided by way of explanation of the subject matter, not limitation thereof. In fact, it will be apparent to those skilled in the art that various modifications and variations may be made in the present subject matter without departing from the scope or spirit of the disclosure. For instance, features illustrated or described as part of one embodiment may be used with another embodiment to yield a still further embodiment.

The following examples will serve to further illustrate the present invention without, at the same time, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

EXAMPLES

Example 1

Three alloys were prepared for strength, elongation, and formability testing. The chemical compositions for these alloys are provided in Table 4. All values are expressed as weight percentage (wt. %) of the whole. In each alloy, the remainder is Al.

TABLE 4

| Alloy | Cu | Fe | Mg | Mn | Si | Ti | Zn | Cr | Zr |
|---|---|---|---|---|---|---|---|---|---|
| A | 1.7 | 0.18 | 2.53 | 0.06 | 0.09 | 0.02 | 5.9 | 0.036 | 0.12 |
| B | 1.68 | 0.19 | 2.57 | 0.03 | 0.09 | 0.02 | 5.94 | 0.04 | 0.12 |
| C | 1.54 | 0.16 | 2.5 | 0.01 | 0.1 | 0.02 | 5.55 | 0.2 | 0.001 |

Alloy A was continuously cast using a twin belt caster according to methods described herein. Two samples of Alloy A, hereafter referred to as A-AC and A-WQ, were subjected to varied cooling techniques upon exit from the caster. Alloy A-AC was cooled in air upon exit from the caster. Alloy A-WQ was quenched with water upon exit from the caster.

Alloys B and C were direct chill (DC) cast according to standards commonly used in the aluminum industry as known to one of skill in the art. Alloys B and C were used as comparative alloys to the exemplary alloys A-AC and A-WQ.

FIG. 1 is a process flow chart describing the comparative and exemplary processing routes. The first route (homogenized, hot rolled, cold rolled; HOMO-HR-CR, left route in FIG. 1) included a traditional slow preheating and homogenizing followed by hot rolling (HR), coil cooling/water quenching, cold rolling (CR), solutionizing (SHT) and aging to obtain the T6-temper properties. The second route (preheated, hot rolled, cold rolled; HTR-HR-CR, center route in FIG. 1) included preheating to about 450° C. to about 480° C. temperature (peak metal temperature, PMT) followed by hot rolling, coil cooling/water quenching, cold rolling, solutionizing (SHT), and aging to obtain the T6-temper properties. The exemplary third route (hot roll to gauge, HRTG, right route in FIG. 1) included preheating and homogenizing the slab and hot rolling to a final gauge followed by coil cooling/water quench, solutionizing (SHT), optional quenching, and aging to obtain the T6-temper properties. Each route included a paint baking simulation after T6 aging to evaluate any decrease in strength.

Figure 2:
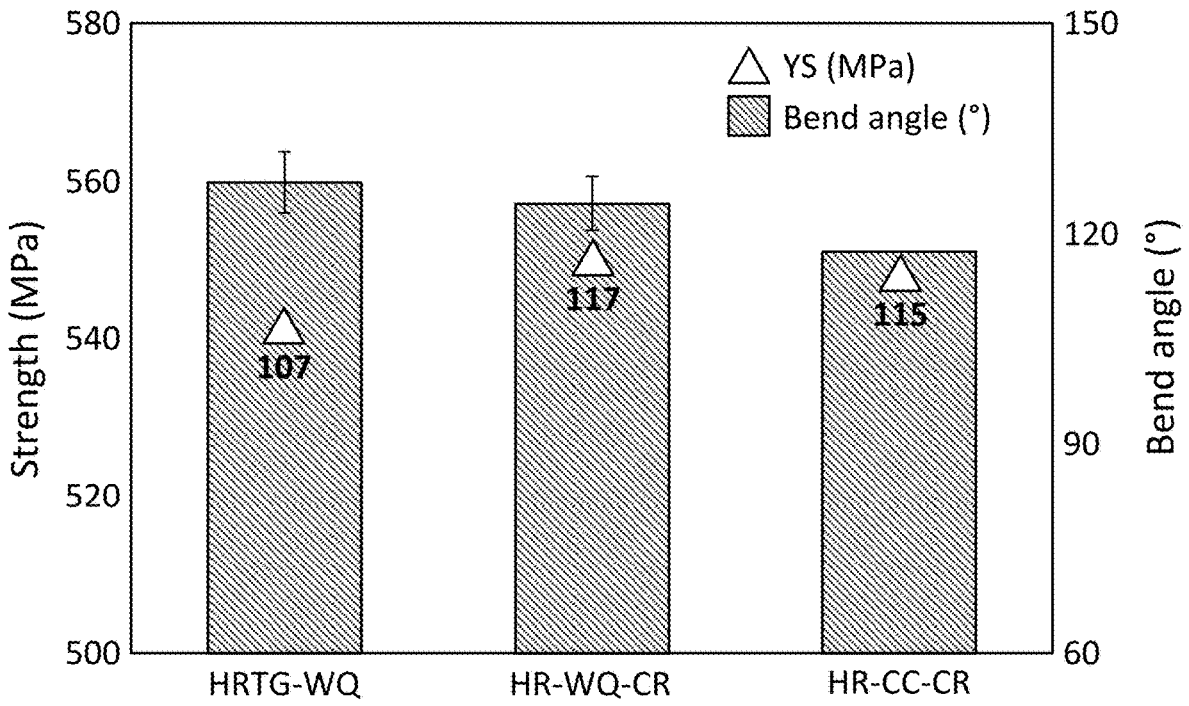
FIG. 2 is a graph showing the yield strength (histogram) and bend angle (triangles) of an exemplary alloy (continuously cast and water quenched upon exit from the continuous caster, referred to herein as "A-WQ") processed by an exemplary route (water quenched after casting, hot roll to gauge, referred to as "HRTG-WQ," See FIG. 1 right route) and comparative processing routes (hot rolled, water quenched, cold rolled, referred to as "HR-WQ-CR" and hot rolled, coiled, cooled, cold rolled, referred to as "HR-CC-CR"). Measurements were taken in the long transverse direction relative to the rolling direction.

The mechanical properties were determined under the ASTM B557 2" GL standard for tensile testing. Formability was determined under Verband der Automobilindustrie (VDA) standards for a 3-point bend test without pre-straining the samples. FIG. 2 is a graph showing the yield strength (YS) (triangle) and bend angle (histogram) of alloy A-WQ tested in the long transverse (L) orientation relative to the rolling direction. Water quenching upon exit from the twin belt continuous caster forced the solute atoms to freeze in place within the matrix rather than precipitate out which prevented further coarsening of precipitates in downstream processing. Direct hot rolling to a final gauge for a water quenched slab produced a superior combination of high strength (ca. 560 MPa) and lower VDA bend angle (ca. 110°). A lower bend angle is indicative of higher formability.

Figure 3:
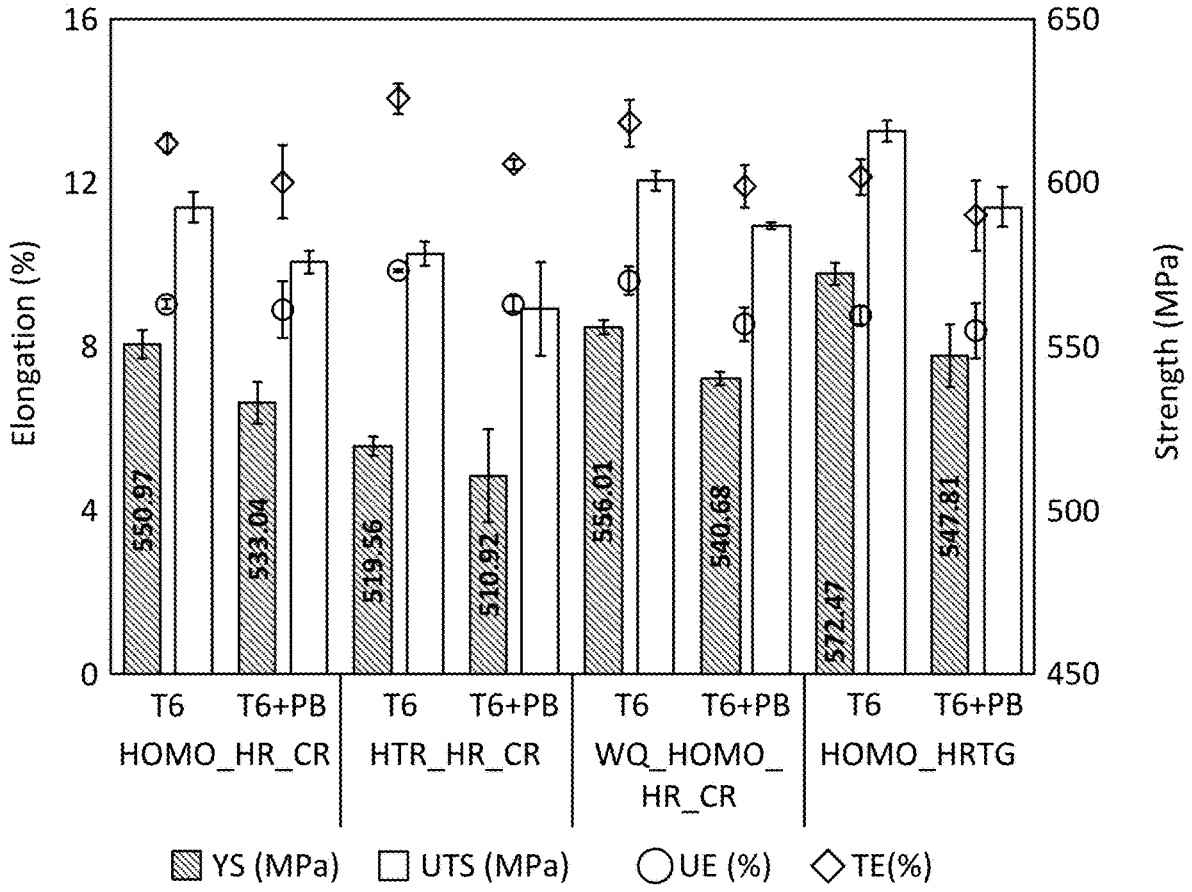
FIG. 3 is a graph showing the tensile properties of an alloy described herein tested after various aging techniques. Alloys were tested after aging to a T6-temper condition (referred to as "T6") and after additional paint baking simulation heat treatment (referred to as "T6+PB"). The left histogram bar in each set represents the yield strength ("YS") of the alloy made according to different methods of making. The right histogram bar in each represents the ultimate tensile strength ("UTS") of the alloy made according to different methods of making. Elongation is represented by circles. The top diamond in each represents the total elongation ("TE") of the alloy made according to different methods of making, and the bottom circle in each represents the uniform elongation ("UE") of the alloy made according to different methods of making. "HOMO-HR-CR" refers to an alloy that was homogenized, hot rolled, coiled, cooled, cold rolled, solutionized and aged. "HTR-HR-CR" refers to an alloy that was pre-heated, hot rolled, coiled, cooled, cold rolled, solutionized and aged. "WQ-HOMO-HR-CR" refers to an alloy that was water quenched at the cast exit, homogenized, hot rolled, coiled, cooled, cold rolled, solutionized and aged. "HOMO-HRTG" refers to an alloy that was homogenized, hot rolled to final gauge, solutionized and aged.

The mechanical properties for alloys A-AC and A-WQ are shown in FIG. 3. Yield strength (YS) (left histogram in each set) and ultimate tensile strength (UTS) (right histogram in each set) are represented by histograms, uniform elongation (UE) is represented by triangles, and total elongation (TE) is represented by circles. The alloys were tested after aging (T6) and after aging and paint baking (T6+PB). Alloy A-AC was processed according to processing route HOMO-HR-CR, HTR-HR-CR, and HRTG and alloy A-WQ was processed according to processing route HOMO-HR-CR (indicated WQ_HOMO_HR_CR). The third processing route without any cold rolling step (HRTG) provided a maximum YS of 572 MPa with a 138° bend angle (See FIG. 4). Processing the alloy via the first route (HOMO-HR-CR) provided a 20 MPa lower YS with similar bend angle. Processing the alloy via the second route (without homogenization) resulted in the lowest strength. Alloy A-WQ (water quench upon caster exit) provided a 6 MPa increase in YS compared to alloy A-AC processed via the second route. Each processing route resulted in similar VDA bend angles regardless of their strength (See FIG. 4). There was a decrease in YS of approximately 20 MPa observed for each sample regardless of processing route after the paint bake simulation (180° C. for 30 min).

Figure 4:
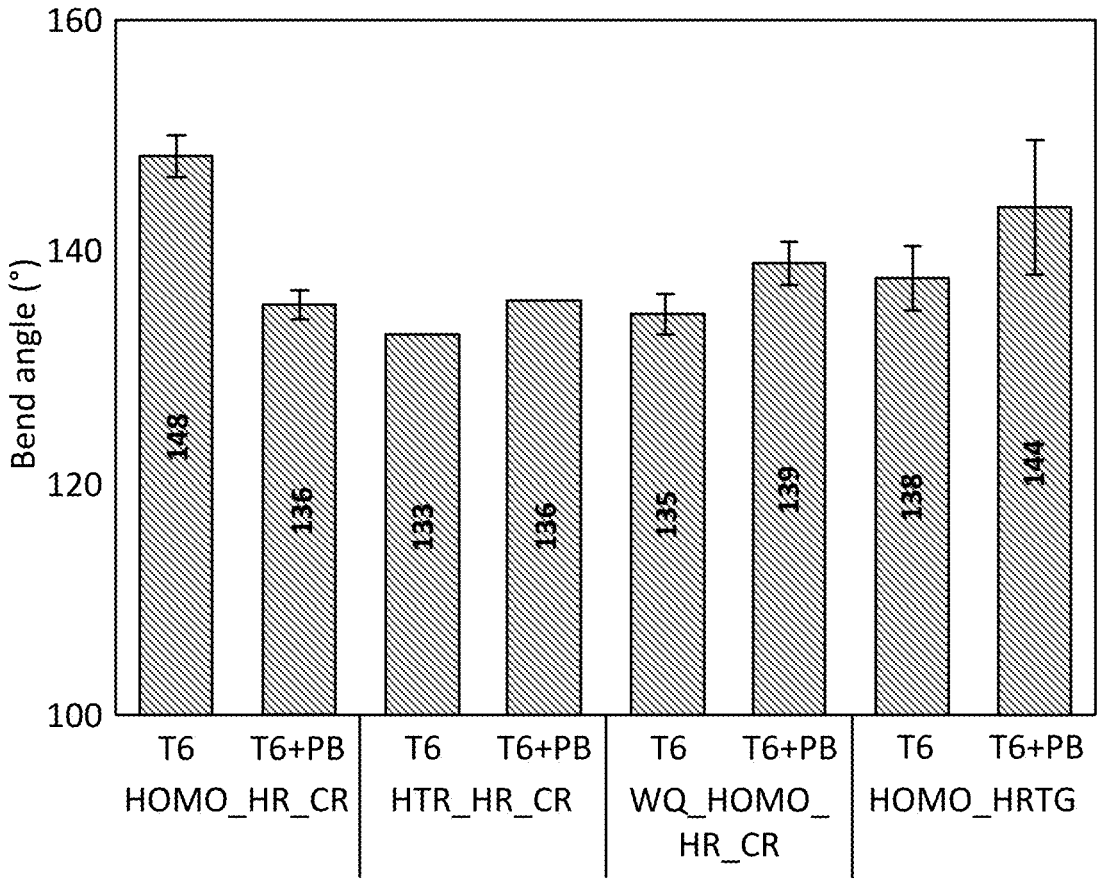
FIG. 4 is a graph showing the bend angle of an alloy processed by the routes described in FIG. 1. The alloy samples were tested after aging to a T6-temper condition (referred to as "T6") and after additional paint baking simulation heat treatment (referred to as "T6+PB"). "HOMO-HR-CR" refers to an alloy that was homogenized, hot rolled, coiled, cooled, cold rolled, solutionized and aged. "HTR-HR-CR" refers to an alloy that was pre-heated, hot rolled, coiled, cooled, cold rolled, solutionized and aged. "WQ-HOMO-HR-CR" refers to an alloy that was water quenched at the cast exit, homogenized, hot rolled, coiled, cooled, cold rolled, solutionized and aged. "HOMO-HRTG" refers to an alloy that was homogenized, hot rolled to final gauge, solutionized and aged.
Figure 5:
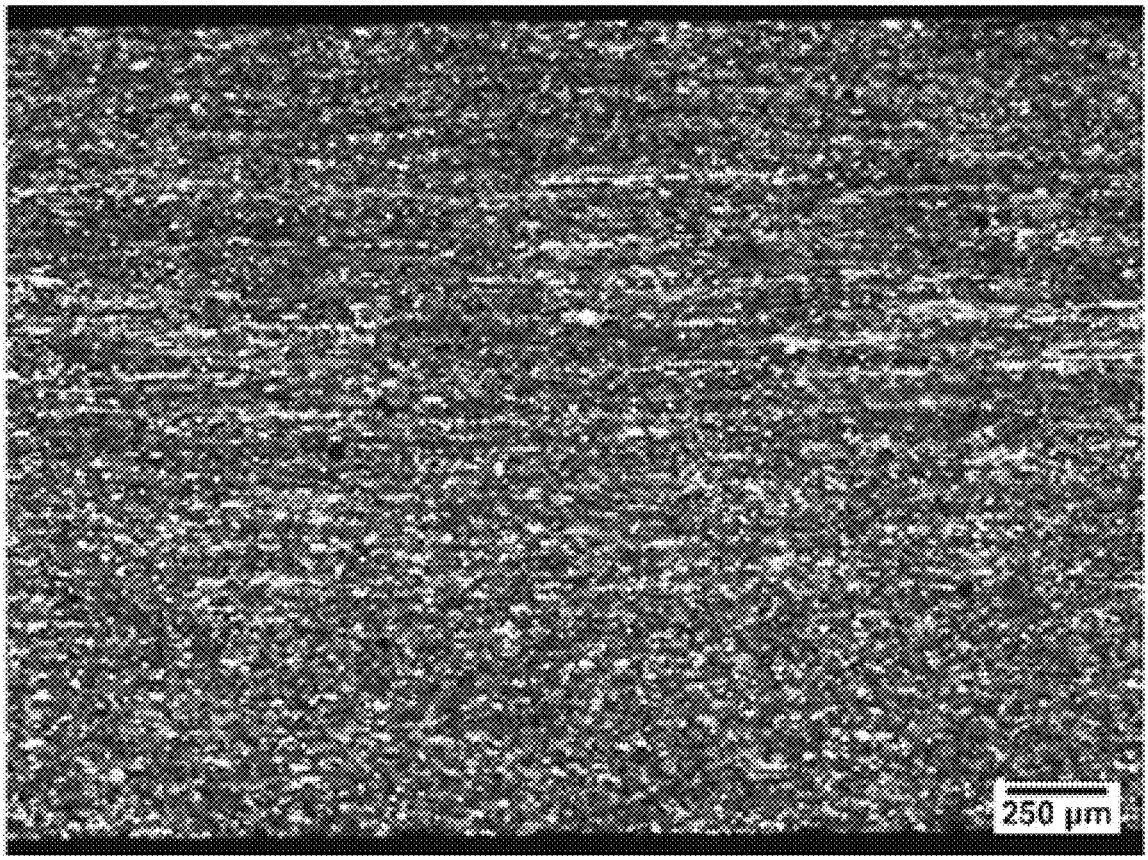
FIG. 5 is a digital image of the grain structure of an alloy processed by the left route of FIG. 1. The as-cast alloy (continuously cast and air cooled upon exiting the continuous caster, referred to herein as "A-AC") was homogenized, hot rolled, coiled, cooled, cold rolled, solutionized and aged ("HOMO-HR-CR") to achieve T6 temper properties.
Figure 6:
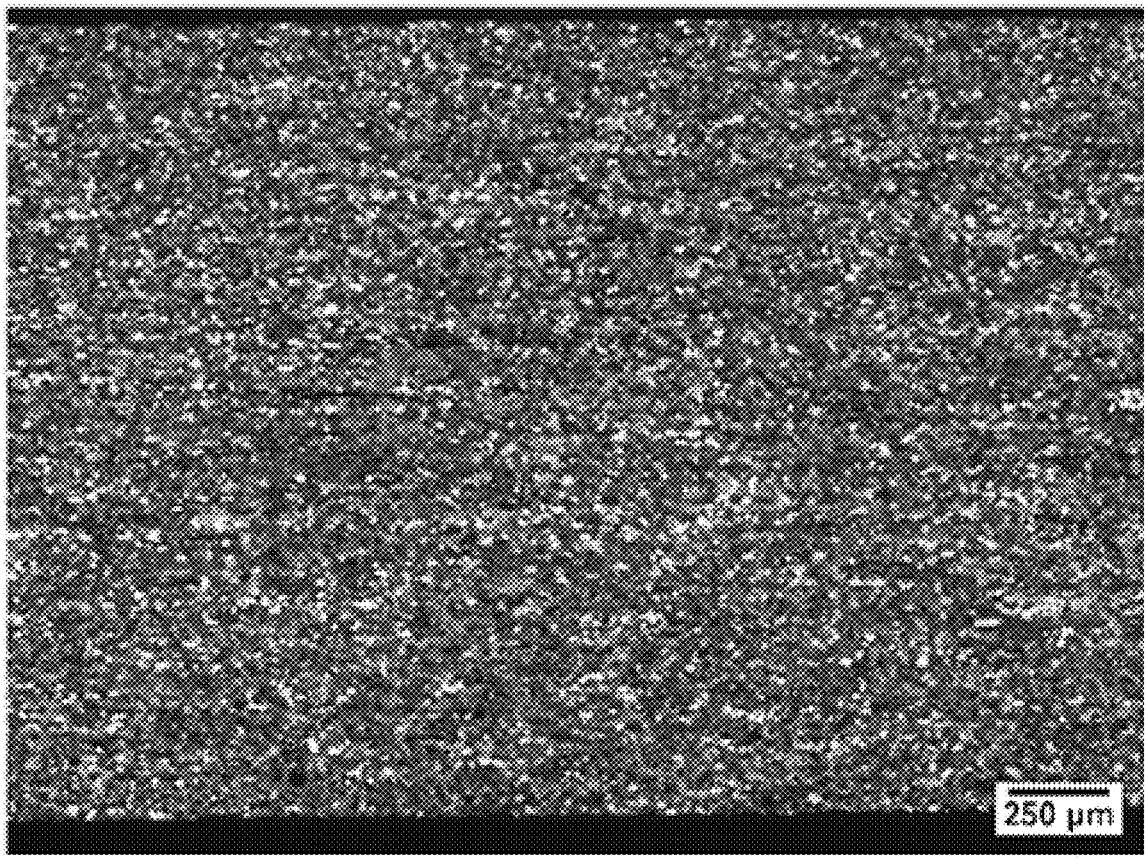
FIG. 6 is a digital image of the grain structure of an alloy processed by the center route shown in FIG. 1. The continuously cast alloy (A-AC) was pre-heated, hot rolled, coiled, cooled, cold rolled, solutionized and aged ("HTR-HR-CR") to achieve T6 temper properties.
Figure 7:
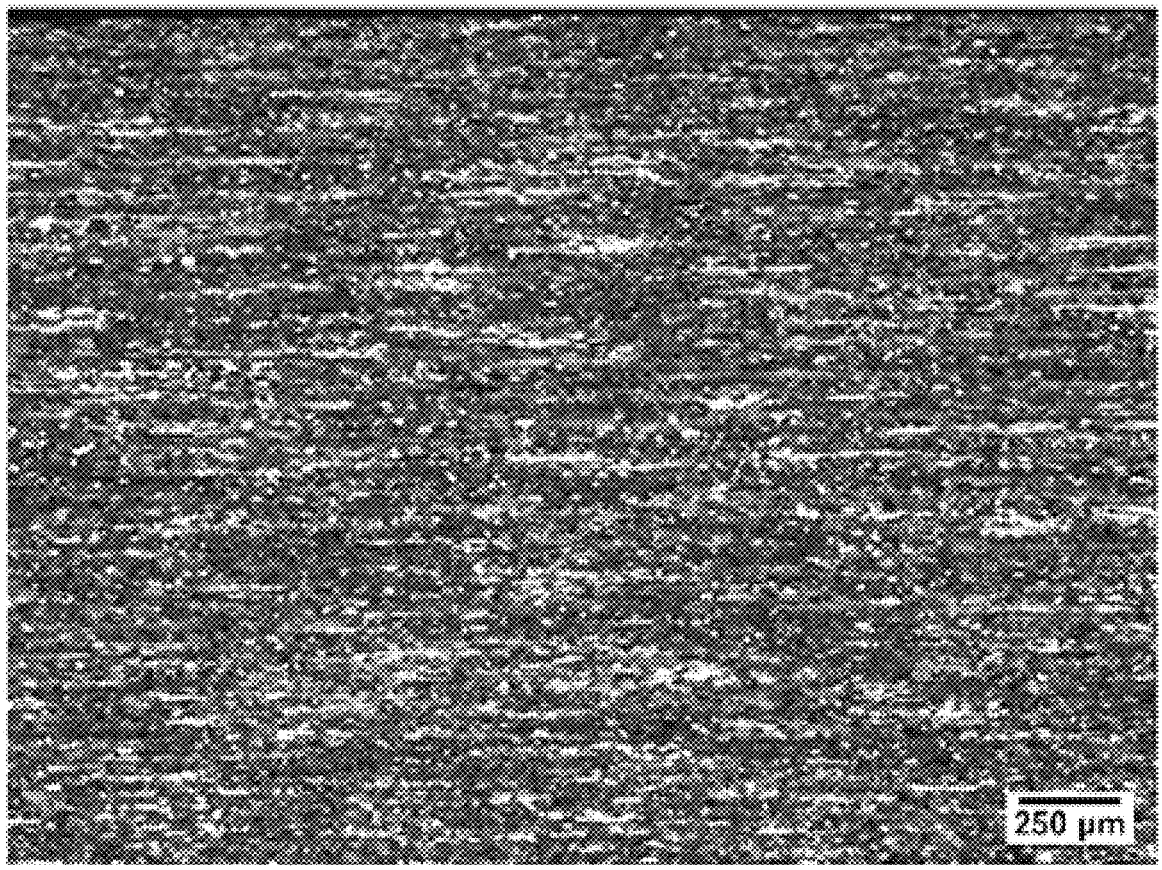
FIG. 7 is a digital image of the grain structure of an alloy processed by the left route shown in FIG. 1. The continuously cast alloy (A-WQ) was water quenched at the cast exit, homogenized, hot rolled, coiled, cooled, cold rolled, solutionized and aged ("WQ-HOMO-HR-CR") to achieve T6 temper properties.
Figure 8:
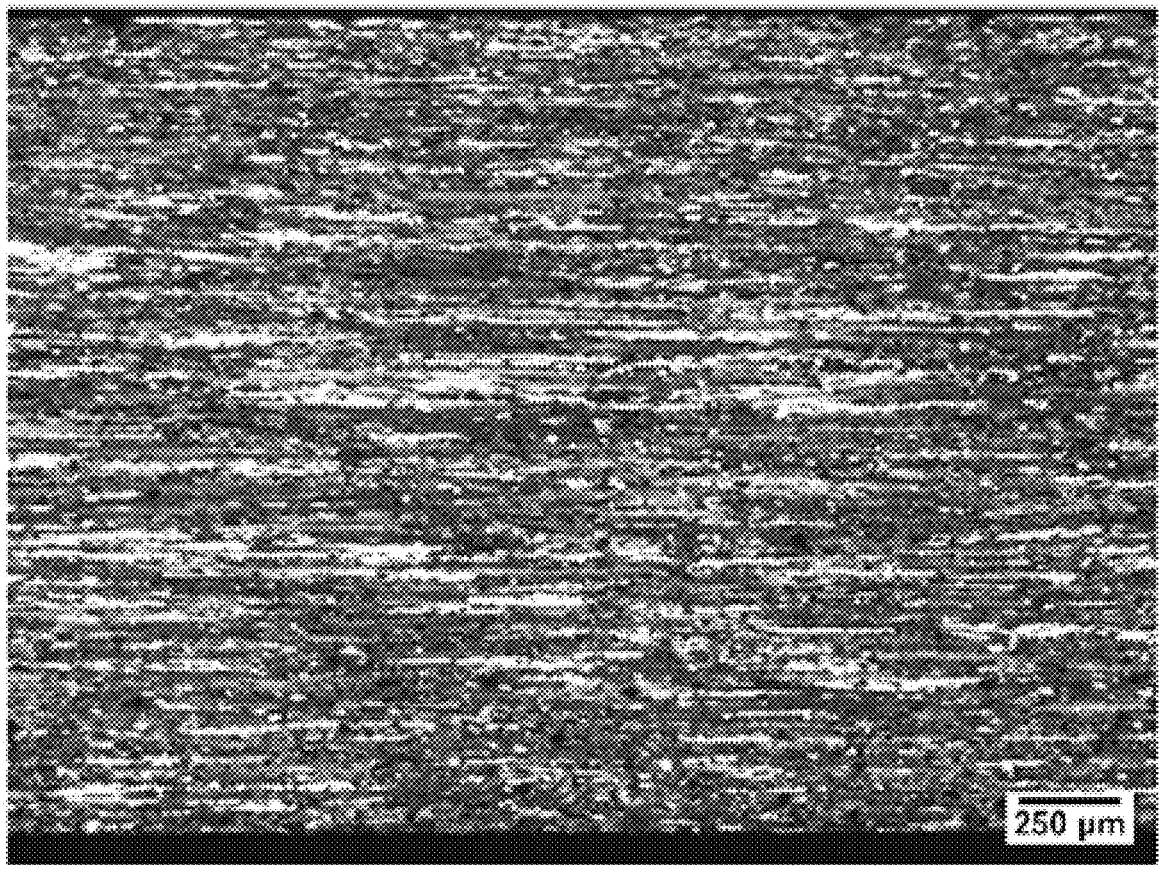
FIG. 8 is a digital image of the grain structure of an exemplary alloy processed by the right route in FIG. 1. The continuously cast alloy (A-AC) was pre-heated, hot rolled to final gauge, solutionized and aged (hot rolled to gauge, "HRTG") to achieve T6 temper properties.

FIGS. 5-8 show the grain structure for the exemplary alloys described in FIGS. 3 and 4. The grain structure of alloy A-AC subjected to the first processing route (HOMO-HR-CR, see FIG. 5) and the second processing route (HTR-HR-CR, see FIG. 6) shows a recrystallized structure. Water quenching upon exit from the caster (alloy CC-WQ, see FIG. 7) and processing without cold rolling (HRTG, see FIG. 8) resulted in an unrecrystallized grain structure, indicated by the elongated grains found in the images. The elongated grains in the HRTG sample explained why it showed the highest strength; however, the bend angle was similar compared to traditional HR (hot roll) and CR (cold roll) practice.

Figure 9:
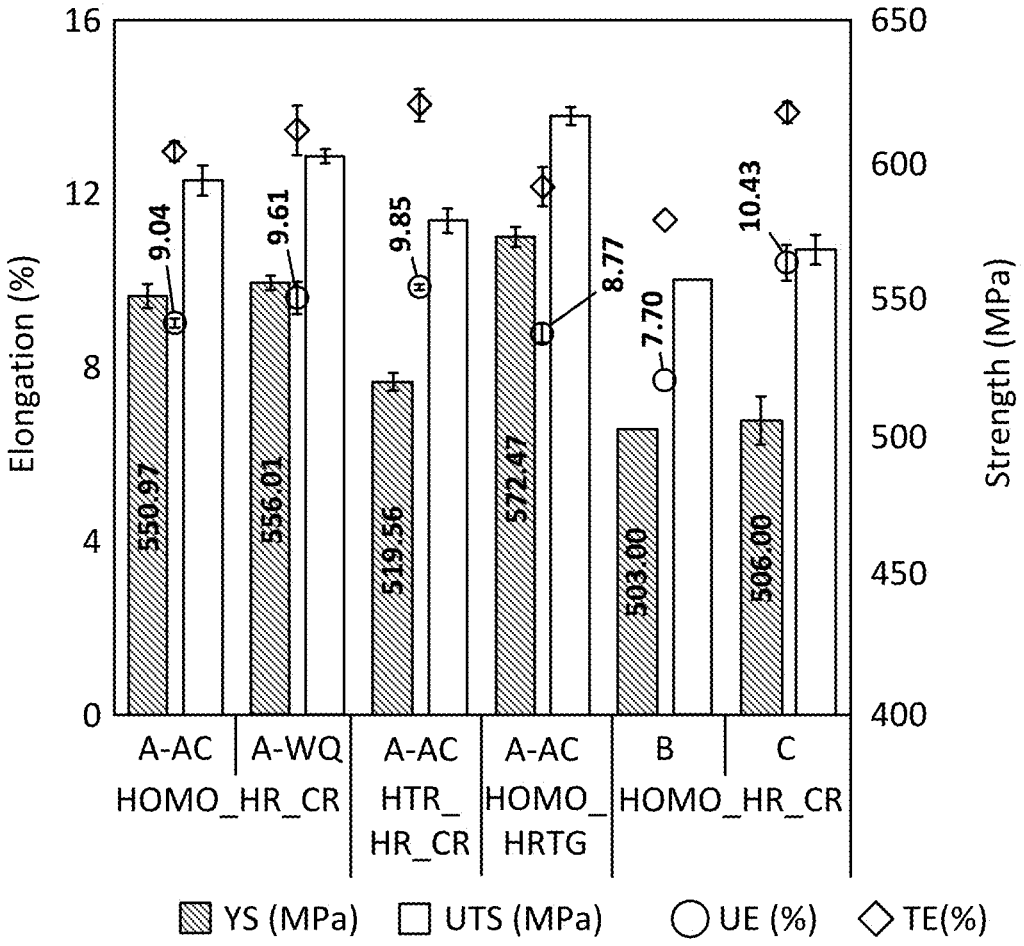
FIG. 9 is a graph showing the tensile properties of two alloys (A-AC and A-WQ) as disclosed herein compared to the tensile properties of two comparative alloys (B and C). The left histogram bar in each set represents the yield strength (YS) of the alloy made according to different methods of making. The right histogram bar in each represents the ultimate tensile strength (UTS) of the alloy made according to different methods of making. The top circle in each represents the total elongation (TE) of the alloy made according to different methods of making, and the bottom diamond in each represents the uniform elongation (UE) of the alloy made according to different methods of making.
Figure 10:
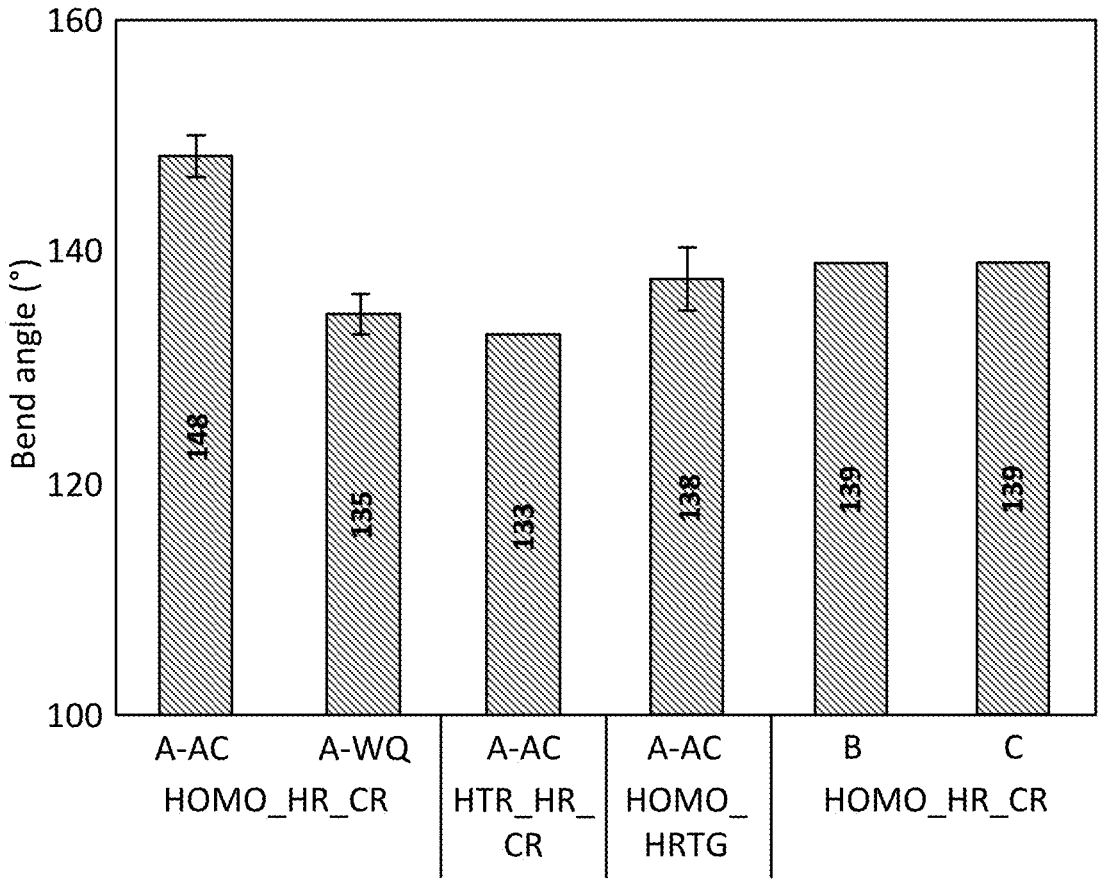
FIG. 10 is a graph showing the bend angle of two alloys (A-AC and A-WQ) as disclosed herein compared to the bend angle of two comparative alloys (B and C). "HOMO-HR-CR" refers to an alloy that was homogenized, hot rolled, coiled, cooled, cold rolled, solutionized and aged. "HTR-HR-CR" refers to an alloy that was pre-heated, hot rolled, coiled, cooled, cold rolled, solutionized and aged. "HOMO-HRTG" refers to an alloy that was homogenized, hot rolled to final gauge, solutionized and aged. "HOMO HR CR" refers to an alloy that was homogenized, hot rolled, cold rolled, solutionized and aged.

The strength and formability of exemplary alloys A-AC and A-WQ were compared to a direct chill cast alloy of the same composition (Alloy B) and of an AA7075 aluminum alloy (Alloy C). The results are shown in FIGS. 9 and 10. The figures show that the properties of alloys A-AC and A-WQ surpass the similar alloys processed by more traditional routes (specifically, processing routes including a cold rolling step). The alloys produced via continuous casting provided 50-60 MPa higher strength with similar bend angles compared to both Alloy B and Alloy C, i.e., the DC cast aluminum alloys.

Figure 11:
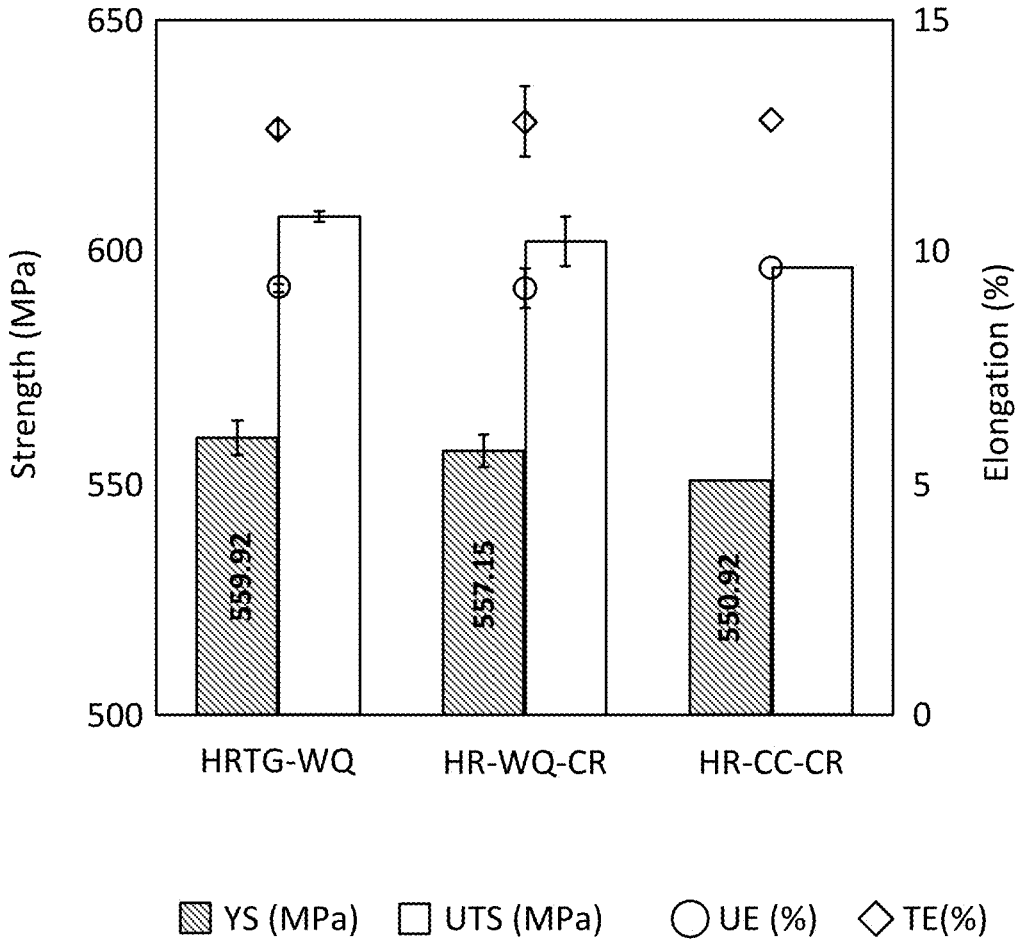
FIG. 11 is a graph of the tensile properties of an exemplary alloy (CC-WQ) processed by an exemplary route (HRTG-WQ, See FIG. 1 right route) and comparative processing routes (hot rolled, water quenched, cold rolled, "HR-WQ-CR" and hot rolled, coiled, cooled, cold rolled, "HR-CC-CR"). The left histogram bar in each set represents the yield strength (YS) of the alloy made according to different methods of making. The right histogram bar in each represents the ultimate tensile strength (UTS) of the alloy made according to different methods of making. The top diamond in each represents the total elongation (TE) of the alloy made according to different methods of making, and the bottom circle in each represents the uniform elongation (UE) of the alloy made according to different methods of making.

Alloy A-WQ was further subjected to various processing routes. The strength and formability results are shown in FIG. 11. Hot rolling to final gauge (HRTG) continued to show superior YS and UTS with similar formability results when the alloy was produced according to processing routes HOMO-HR-CR and when water quenched after hot rolling and subsequently cold rolled to a final gauge (indicated HR-WQ-CR).

Figure 12:
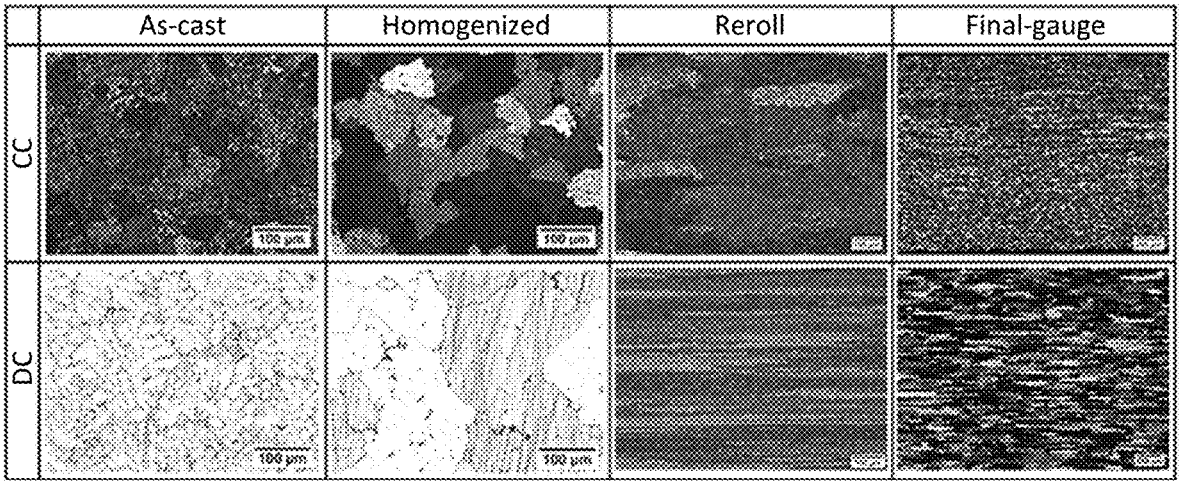
FIG. 12 shows digital images of the grain structures of exemplary and comparative alloys described herein. The top row ("CC") shows the grain structure of an exemplary alloy (A-AC) after completion of four steps in the processing route, including after continuous casting (As-cast), after homogenization (Homogenized), after hot rolling (Reroll) and after rolling to the final gauge (Final-gauge). The bottom row ("DC") shows the grain structure of a comparative direct chill cast alloy (C) from the same points in the processing route.
Figure 13:
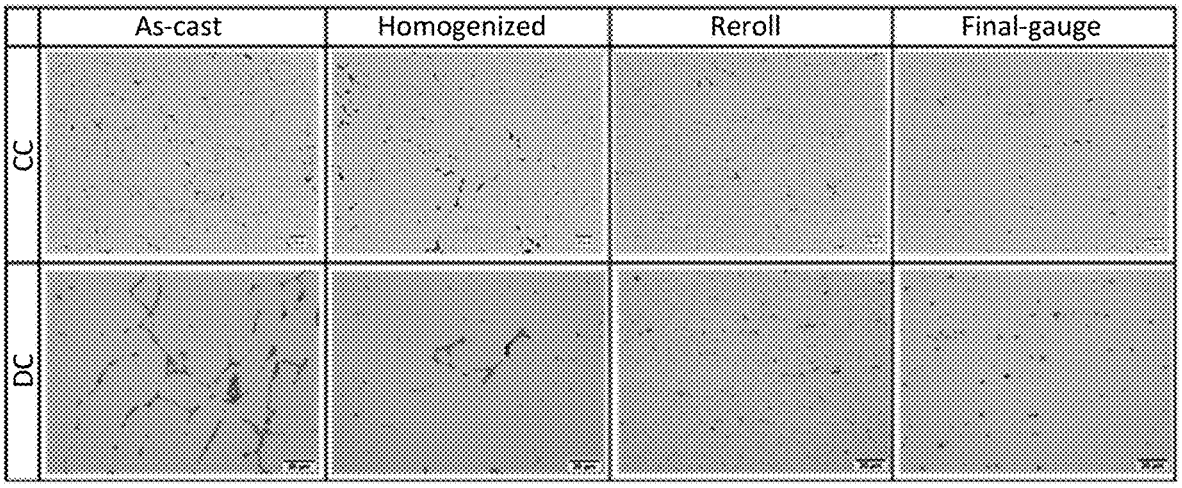
FIG. 13 shows digital images of the particle content of exemplary and comparative alloys described herein. The top row ("CC") shows the particulate content of an exemplary alloy (A-AC) after completion of four steps in the processing route, including after continuous casting (As-cast), after homogenization (Homogenized), after hot rolling (Reroll) and after rolling to the final gauge (Final-gauge). The bottom row ("DC") shows the particulate content of a comparative direct chill cast alloy (C) from the same points in the processing route.

The increase in strength and formability that was provided by continuous casting 7xxx series aluminum alloys can be attributed to the difference in grain size (See FIG. 12) and particle size and morphology (See FIG. 13). Smaller grain size and particles were observed in the continuous cast alloys (indicated as CC in FIGS. 12 and 13) when compared to DC cast alloys (indicated as DC in FIGS. 12 and 13) throughout the entire process, including after casting (As-cast), homogenization (Homogenized), hot rolling and coiling (Reroll) and rolling to a final gauge (Final-gauge).

Example 2

Eight aluminum alloys, Alloys D-K, were prepared for strength and elongation testing. The chemical compositions for these alloys are provided in Table 5. All values are expressed as weight percentage (wt. %) of the whole. In each alloy, the remainder is Al.

TABLE 5

| Alloy | Cu | Fe | Mg | Mn | Si | Ti | Zn | Cr | Zr |
|---|---|---|---|---|---|---|---|---|---|
| D-G | 1.67 | 0.18 | 2.53 | 0.07 | 0.10 | 0.02 | 5.90 | 0.04 | 0.12 |
| H-K | 1.20 | 0.19 | 2.28 | 0.05 | 0.10 | 0.02 | 9.11 | 0.03 | 0.13 |
| L | 1.57 | 0.12 | 2.70 | 0.01 | 0.08 | 0.03 | 5.59 | 0.24 | 0.00 |

Alloys D-G have the same chemical composition but were processed according to different methods, as shown in Table 6. Alloys H-K have the same chemical composition but were processed according to different methods, as shown in Table 6. Alloy L is an AA7075 alloy. In Table 6, "HR" refers to hot roll, "HRTG" refers to hot roll to gauge, and "SHT" refers to solution heat treatment.

TABLE 6

| | Process | | | | |
|---|---|---|---|---|---|
| Alloy | Homogenization | Rolling | Reheat | Finishing | SHT |
| D | 450° C. - 1 min | 50% HR | 480° C./1 hr | HRTG | 480° C. - 5 min |
| E | 450 C. ° - 1 min | 50% HR | 480° C./2 hr | HRTG | 485° C. - 2 min |

TABLE 6-continued

| Alloy | Process | | | | |
|---|---|---|---|---|---|
| | Homogenization | Rolling | Reheat | Finishing | SHT |
| F | Furnace | 50% HR | 480° C./2 hr | HRTG | 480° C. - 5 min |
| G | 450° C. - 1 min | 50% HR | 480° C./2 hr | HRTG | 480° C. - 5 min |
| H | 450° C. - 1 min | 50% HR | 480° C./1 hr | HRTG | 480° C. - 5 min |
| I | 450° C. - 1 min | 50% HR | 480° C./2 hr | HRTG | 485° C. - 2 min |
| J | Furnace | 50% HR | 480° C./2 hr | HRTG | 480° C. - 5 min |
| K | 450° C. - 1 min | 50% HR | 480° C./2 hr | HRTG | 480° C. - 5 min |
| L | AA7075 DC ingot produced via conventional methods | | | | |

Specifically, the Alloys D-K were continuously cast using a twin belt caster according to methods described herein. The continuously cast slabs were pre-heated and homogenized under the conditions listed in Table 6, hot rolled to a 2 mm final gauge (representing a 50% reduction), quenched, reheated under the conditions listed in Table 6, and solutionized (SHT) under the conditions listed in Table 6. Additionally, a comparative alloy (Alloy L) was prepared and tested to compare the mechanical properties of alloys produced according to the methods described herein to the mechanical properties of alloys produced by conventional methods. Specifically, Alloy L was prepared by direct chill (DC) casting an ingot, homogenizing the ingot, hot rolling the ingot to an intermediate gauge aluminum alloy article, cold rolling the intermediate gauge aluminum alloy article to a 2 mm final gauge aluminum alloy article, and solutionizing the final gauge aluminum alloy article.

Alloys D-L were aged at 125° C. for 24 hours to result in the T6 temper. The mechanical properties of the alloys in T6 temper are shown in Table 7 below. Specifically, Table 7 shows the yield strength ("YS"), the ultimate tensile strength ("UTS"), the total elongation, and the uniform elongation of each of Alloys D-L.

TABLE 7

| Alloy | T6 (125° C./24 hours) | | | |
|---|---|---|---|---|
| | YS (MPa) | UTS (MPa) | Total Elongation (%) | Uniform Elongation (%) |
| D | 532 | 597 | 10.2 | 13.3 |
| E | 523 | 571 | 5.7 | 5.9 |
| F | 552 | 598 | 7.7 | 9.9 |
| G | 561 | 607 | 8.0 | 10.6 |
| H | 603 | 644 | 7.3 | 8.8 |
| I | 591 | 635 | 6.2 | 8.8 |
| J | 604 | 632 | 2.0 | 2.1 |
| K | 609 | 648 | 5.2 | 7.4 |
| L | 520 | 575 | 11.2 | 14.6 |

Alloys D-L in the T6 temper were additionally paint-baked (referred to the Table 8 as "PB") at 180° C. for 30 minutes. Table 8 shows the yield strength ("YS"), the ultimate tensile strength ("UTS"), the total elongation, and the uniform elongation of each of Alloys D-L. In addition, Table 8 shows the difference in yield strength between the T6 temper alloy with and without paint baking ("YS PB Δ T6").

TABLE 8

| Alloy | T6 + PB (180° C./30 minutes) | | | | |
|---|---|---|---|---|---|
| | YS (MPa) | UTS (MPa) | Total Elongation (%) | Uniform Elongation (%) | YS PB Δ T6 (MPa) |
| D | 530 | 580 | 8.7 | 11.2 | −2.5 |
| E | 520 | 561 | 6.6 | 7.4 | −3.5 |
| F | 554 | 591 | 6.6 | 8.3 | 1.7 |
| G | 552 | 596 | 7.7 | 10.2 | −8.5 |
| H | 603 | 618 | 3.5 | 6.1 | −0.8 |
| I | 598 | 617 | 3.5 | 5.9 | 6.9 |
| J | 608 | 620 | 2.8 | 3.3 | 3.9 |
| K | 613 | 628 | 3.6 | 5.8 | 3.9 |
| L | 494 | 560 | 10.7 | 13.7 | −26.0 |

The alloys were also tested in T4 temper after direct paint-baking (i.e., without performing an aging process to result in a T6 temper) at 180° C. for 30 minutes. Table 9 shows the yield strength ("YS"), the ultimate tensile strength ("UTS"), the total elongation, and the uniform elongation of each of Alloys D-L.

TABLE 9

| Alloy | T4 + PB (180° C./30 minutes) | | | |
|---|---|---|---|---|
| | YS (MPa) | UTS (MPa) | Total Elongation (%) | Uniform Elongation (%) |
| D | 506 | 562 | 9.0 | 11.6 |
| E | 508 | 558 | 8.6 | 11.4 |
| F | 504 | 557 | 7.3 | 8.9 |
| G | 508 | 563 | 7.6 | 9.7 |
| H | 593 | 613 | 3.1 | 3.4 |
| I | 595 | 616 | 3.4 | 6.1 |
| J | 601 | 617 | 3.2 | 4.0 |
| K | 604 | 621 | 3.6 | 5.9 |
| L | 429 | 503 | 12.0 | 9.8 |

As shown in Tables 7, 8, and 9 above, Alloys D-K exhibited exceptional strength in the T4 and T6 tempers, with and without paint baking. In addition, Alloys D-K showed either a strength gain or a minimal/negligible loss in strength after the paint baking step was employed. Alloy L (comparative alloy) exhibited a large decrease in strength after the paint baking step as shown in Table 8, YS PB Δ T6. The data demonstrate that the DC cast and conventionally processed AA7075 alloy underwent overaging after paint baking. Surprisingly, Alloys D-K, produced by the exemplary methods described herein, exhibited an ability to undergo thermal processing without any negative impact (e.g., no overaging and no decrease in strength).

Various embodiments of the invention have been described in fulfillment of the various objectives of the invention. It should be recognized that these embodiments are merely illustrative of the principles of the present invention. Numerous modifications and adaptations thereof will be readily apparent to those of ordinary skill in the art without departing from the spirit and scope of the invention as defined in the following claims.

What is claimed is:

1. A method of producing an aluminum alloy product, comprising:

continuously casting an aluminum alloy to form a slab, wherein the aluminum alloy comprises 0.03-1.2 wt. % Si, 0.0-1.5 wt. % Fe, 1.0-3.0 wt. % Cu, 0.005-0.9 wt. % Mn, 0.7-8.7 wt. % Mg, 0-0.3 wt. % Cr, 1.7-18.3 wt. % Zn, 0.005-0.6 wt. % Ti, 0-0.4 wt. % Zr, up to 0.15 wt. % of impurities, and Al;

cooling the slab at a rate from 1° C./s to 200° C./s upon exit from a continuous caster that continuously casts the slab;

heating the slab to a temperature of no more than 500° C. at a heating rate of from 100° C./min to 10° C./min;

soaking the heated slab at the temperature for a soak time of 10 seconds to 36 hours; and hot rolling the slab to a final gauge without cold rolling the slab prior to the final gauge, wherein the aluminum alloy product has a yield strength of 400 to 650 MPa at peak age condition.

2. The method of claim 1, wherein the aluminum alloy comprises 0.06-0.35 wt. % Si, 0.12-0.45 wt. % Fe, 1.0-3.0 wt. % Cu, 0.01-0.25 wt. % Mn, 1.5-5.0 wt. % Mg, 0.01-0.25 wt. % Cr, 3.5-15.5 wt. % Zn, 0.01-0.15 wt. % Ti, 0.001-0.18 wt. % Zr, and up to 0.15 wt. % of impurities, and Al.

3. The method of claim 1, wherein the aluminum alloy comprises 0.07-0.13 wt. % Si, 0.16-0.22 wt. % Fe, 1.3-2.0 wt. % Cu, 0.01-0.08 wt. % Mn, 2.3-2.65 wt. % Mg, 0.02-0.2 wt. % Cr, 5.0-10.0 wt. % Zn, 0.015-0.04 wt. % Ti, 0.001-0.15 wt. % Zr, up to 0.15 wt. % of impurities, and Al.

4. The method of claim 1, wherein the cooling step comprises quenching the slab with water.

5. The method of claim 1, wherein the cooling step comprises air cooling the slab.

6. The method of claim 1, wherein the continuously cast slab is coiled before the step of hot rolling the slab.

7. The method of claim 1, further comprising:

coiling the slab into an intermediate coil before hot rolling the slab to the final gauge;

pre-heating the intermediate coil before hot rolling the slab to the final gauge; and homogenizing the intermediate coil before hot rolling the slab to the final gauge.

8. The method of claim 1, further comprising:

solutionizing the aluminum alloy product of the final gauge;

quenching the aluminum alloy product of the final gauge; and aging the aluminum alloy product of the final gauge.

9. The method of claim 1, wherein the slab is devoid of cracks having a length greater than 8.0 mm after the continuous casting and before the hot rolling.

10. The method of claim 1, further comprising pre-heating the slab prior to hot rolling.

11. A method of producing an aluminum alloy, comprising:

continuously casting an aluminum alloy to form a slab, wherein the aluminum alloy comprises 0.03-1.2 wt. % Si, 0.06-1.5 wt. % Fe, 1.0-3.0 wt. % Cu, 0.005-0.9 wt. % Mn, 0.7-8.7 wt. % Mg, 0-0.3 wt. % Cr, 1.7-8.3 wt. % Zn, 0.005-0.6 wt. % Ti, 0-0.4 wt. % Zr, up to 0.15 wt. % of impurities at up to 0.05 wt. % for each impurity, and Al;

cooling the slab at a rate from 1° C./s to 200° C./s upon exit from a continuous caster that continuously casts the slab;

heating the slab to a temperature of no more than 500° C. at a heating rate of from 100° C./min to 10° C./min; and hot rolling the slab to a final gauge and a final temper; wherein the aluminum alloy product has a yield strength of 400 to 6501VIPa at peak age condition.

12. The method of claim 11, wherein the aluminum alloy comprises 0.07-0.13 wt. % Si, 0.16-0.22 wt. % Fe, 1.3-2.0 wt. % Cu, 0.01-0.08 wt. % Mn, 2.3-2.65 wt. % Mg, 0.02-0.2 wt. % Cr, 5.0-10.0 wt. % Zn, 0.015-0.04 wt. % Ti, 0.001-0.15 wt. % Zr, up to 0.15 wt. % of impurities, and Al.

13. The method of claim 11, wherein the slab is devoid of cracks having a length greater than 8.0 mm after the continuous casting and before the hot rolling.

14. The method of claim 11, wherein a cold rolling step is not performed.

* * * * *